US005409804A

United States Patent [19]

Inaba et al.

[11] Patent Number: 5,409,804

[45] Date of Patent: Apr. 25, 1995

[54] PHOTOGRAPHIC PROCESSING COMPOSITION AND PROCESSING METHOD

[75] Inventors: Tadashi Inaba; Hisashi Okada; Hiroyuki Seki, all of Kanagawa, Japan

[73] Assignee: Fuji Photo Film Co., Ltd., Kanagawa, Japan

[21] Appl. No.: 185,234

[22] Filed: Jan. 24, 1994

Related U.S. Application Data

[63] Continuation of Ser. No. 940,225, Sep. 3, 1992, abandoned.

[30] Foreign Application Priority Data

Sep. 5, 1991 [JP] Japan ..... 3-252775

[51] Int. Cl.[6] ..... G03C 7/42

[52] U.S. Cl. ..... 430/393; 430/430; 430/460; 430/461

[58] Field of Search ..... 430/393, 430, 460, 461

[56] References Cited

U.S. PATENT DOCUMENTS

| | | | |
|---|---|---|---|
| 4,835,092 | 5/1989 | Ishikawa et al. | 430/490 |
| 5,028,517 | 7/1991 | Kuse et al. | 430/490 |
| 5,075,202 | 12/1991 | Koboshi et al. | 430/460 |
| 5,188,927 | 2/1993 | Okada et al. | 430/393 |
| 5,217,855 | 6/1993 | Okada et al. | 430/430 |
| 5,350,668 | 9/1994 | Abe et al. | 430/393 |

FOREIGN PATENT DOCUMENTS

| | | | |
|---|---|---|---|
| 2083830 | 12/1971 | France | G03C 1/00 |

*Primary Examiner*—Hoa Van Le

*Attorney, Agent, or Firm*—Sughrue, Mion, Zinn, Macpeak & Seas

[57] ABSTRACT

A Photographic processing composition and a processing method using the same, wherein the composition contains a compound represented by formula (I) or a chelating compound of Fe(III) , $M_n$(III), Co(III), Rh(II), Rh(III), Au(II), Au(III) or Ce(IV) and a compound represented by formula (I);

(I)

wherein $X_1$, $X_2$, and $X_3$ each represents a hydrogen atom, —L—COOM, or at least one of $X_1$, $X_2$, and $X_3$ represents represents a carbon atomic group necessary for forming an aryl group; $R_1$ represents a hydrogen atom or a substituent group; $R_2$ represents an alkyl group, an alkoxy group, an acrylamino group, an alkylsulfonylamino group, an arylsulfonylamino group, a ureido group, an alkoxycarbonylamino group, an aryloxycarbonylamino group, a sulfamoyl group, a carbamoyl group, an alkylthio group, an alkylsulfonyl group, an arylsulfonyl group, an alkylsulfinyl group, an arylsulfinyl group, a hydroxy group, a halogen atom, a cyano group, $—SO_3M^1$, $—COOM^1$, $—PO_3M^1M^2$ group, an acyl group, an alkoxycarbonyl group, an acyloxy group,a nitro group, or a hydroxamic acid group; n represents 0 or an integer of from 1 to 7; L represents an alkylene group; M, $M^1$ and $M^2$ each represents a hydrogen atom or a cation; and W represents a divalent linkage group containing an alkylene group and/or an arylene group.

11 Claims, No Drawings

PHOTOGRAPHIC PROCESSING COMPOSITION AND PROCESSING METHOD

This is a continuation of application Ser. No. 07/940,225, filed Sep. 3, 1992, now abandoned.

FIELD OF THE INVENTION

The present invention relates to a processing composition for silver halide photographic materials and a processing method using the processing composition, and more particularly to a processing composition containing a novel chelating agent for masking metal ions harmful for photographic processing and a processing method using the same. Furthermore, the invention relates to a photographic processing composition containing a novel bleaching agent for a bleach step in color development processing and a processing method using the same.

BACKGROUND OF THE INVENTION

In general, a silver halide black and white photographic material is, after imagewise-exposure, processed by the processing steps of black and white development, fixing, washing, etc., and a silver halide color photographic material (hereinafter, referred to as "color photographic material") is, after imagewise-exposure, processed by the processing steps of color development, desilvering, washing, stabilization, etc. Also, a silver halide color reversal photographic material is, after imagewise exposure, processed by the processing steps of black and white development, reversal processing, color development, desilvering, washing, stabilization, etc.

In the color development step for photographic processing, exposed silver halide grains are converted into silver by being reduced with a color developing agent and at the same time, the oxidation product of the color developing agent formed reacts with couplers to form dye images.

Then, in the subsequent desilvering step, developed silver formed by the development step is oxidized into a silver salt by a bleaching agent having an oxidative action (bleach), and further the silver salt is removed from the light-sensitive layer together with remaining silver halide by a fixing agent forming a soluble silver (fix). Bleaching and fixing may be carried out independently as a bleach step and a fix step or may be carried out simultaneously as a bleach-fix (blix) step. Details of the compositions and the processing steps are described in T. H. James, *The Theory of Photographic Process*, 4th edition, (1977), *Research Disclosure*, No. 17643, pages 28 to 29, ibid., 18716, page 651, left column to right column, ibid., No. 307105, pages 880 to 881.

In addition to the foregoing fundamental processing steps, various auxiliary steps are added for the purposes of keeping the photographic and physical qualities of dye images and keeping the stability of photographic processing. For example, there are a wash step, a stabilization step, a hardening step, a stop step, etc.

The foregoing processing steps are generally carried out by an automatic processor. Photographic processing is carried out in various places, such as large-scale laboratories, employing large automatic processors. Recently, photo stores have employed small automatic processors called "mini labs". With the increase of such automatic processors, the reduction of the processing power sometimes happens.

One of the large causes of such reduction is entrance of metal ions in the processing solutions.

Various metal ions enter the processing solution through various routes. For example, calcium ions, a magnesium ions, and, in some cases, iron ions enter the processing solution through water being used for preparing the processing solution or calcium ions contained in the gelatin of silver halide photographic materials enters the processing solution. Also, it sometimes happens that by sputtering of a blix solution, an iron chelate contained in the blix solution enters a developer which is the preceding bath. Further, metal ions contained in a preceding bath are carried in by photographic films impregnated with the solution in the preceding bath.

The influences by the intermixed metal ions differ according to the kinds of the metal ions and the processing solution.

For example, calcium ions and magnesium ions in a developer react with a carbonate, which is used as a buffer in the developer, and form precipitates and sludges, which cause the problems of clogging a filter in a circulation system of an automatic processor and in staining photographic films so processed. Also, the entrance of transition metal salts such as iron ions, etc., in a color developer or a black and white developer causes decomposition of a paraphenylenediamine color developing agent, a black and white developing agent, such as hydroquinone, monol (monomethyl-p-aminophenol sulfate), etc., or a preservative, such as hydroxylamine, a sulfite, etc. This results in greatly lowering the photographic characteristics.

Also, when transition metal ions such as iron ions, etc., enter a bleach solution using hydrogen peroxide, persulfate, etc., the stability of the bleach solution is greatly lowered. This causes the problems of inferior bleaching, etc.

Furthermore, when a transition metal salt enters an ordinary fix solution containing a thiosulfate, the stability of the fix solution is lowered. This causes turbidity and sludges in the fix solution. As a result thereof, the filter of the automatic processor is clogged, which reduces the circulating flow amount, whereby fixing becomes inferior, and the photographic films processed become stained. Such a phenomenon in a fix solution also occurs in wash water, which is used subsequent to fixing. In particular, when the amount of wash water is reduced, the exchange ratio of the liquids in the tanks is lowered, whereby the problems of the decomposition of a thiosulfate, which is called sulfiding, and the formation of the precipitations of silver sulfide, are extremely liable to occur.

When such a state occurs, the surface of the photographic film processed is frequently severely stained.

In a stabilization solution prepared using hard water containing a large amount of calcium and magnesium, bacteria grow using calcium and magnesium as a nutrient. This makes the solution turbid and stains the photographic films so processed. Also, when transition metal ions, such as iron ions enter a stabilization solution, the metal ions remain on the surface of a photographic film so processed, thereby the storage stability of the photographic film after processing is deteriorated.

Since, as described above, the entrance of metal ions in processing solutions cause various troubles, effective masking agents for metal ions have been strongly desired.

As a method of solving the foregoing problems, chelating agents capable of masking metal ions have been used. As such chelating agents, there are, for example, the aminopolycarboxylic acids (e.g., ethylenediaminetetraacetic acid and diethylenetriaminepentaacetic acid) described in JP-B-48-30496 and JP-B-44-30232 (the term "JP-B" as used herein means an "examined Japanese patent publication"), the organic phosphonic acids described in JP-A-56-97347 (the term "JP-A" as used herein means an "unexamined published Japanese patent application"), JP-B-56-39359, and West German Patent 2,227,639, the phosphonocarboxylic acids described in JP-A-52-102726, JP-A-53-42730, JP-A-54-121127, JP-A-55-126241, and JP-A-55-65956, and the compounds described in JP-A-58-195845, JP-A-58-203440, and JP-B-53-40900.

Some of these foregoing compounds are practically used but the performance thereof is yet insufficient. For example, ethylenediaminetetraacetic acid shows a large masking ability to a calcium ions, but when the compound is added to a developer, it accelerates the decomposition of a developing agent and a preservative for the developing agent in the presence of iron ions which causes the deterioration of the photographic characteristics such as lowering of the image density and an increase of the formation of fog. Also, for example, alkylidenediphosphonic acid does not cause such a bad action even in the presence of iron ions but, when this compound is added to a processing solution prepared using hard water having a large content of calcium, solid matters are formed in the solution. This causes a problem for an automatic processor.

In particular, recently, with the increase of the social requirement, of environmental preservation, the replenishing amount of each photographic processing solution tends to be more and more reduced. With the reduction of the replenishing amount, the residence time of each processing solution in the automatic processor is prolonged. Hence, the foregoing deterioration of the storage stability becomes a larger problem than in conventional cases.

Accordingly, the development of an excellent novel chelating agent which can effectively mask metal ions accumulated in a processing solution without causing any problems has been strongly desired.

Also, with the increase of the use of mini labs for processing of color photographic materials, a quick processing service for customers has been increased.

However, ethylenediaminetetraacetic acid ferric complex salt, which is conventionally used as a bleaching agent for a bleach step and/or a blix step in processing of color photographic materials, has a fundamental fault in that the oxidative power is weak. In spite of that the improvement such as the use of a bleach accelerator (e.g., the addition of the mercapto compound described in U.S. Pat. No. 1,138,842), etc., is added. However, quick bleaching has not yet been attained.

As a bleaching agent capable of attaining quick bleaching, potassium ferricyanide, iron chloride, bromates, etc., are known. However, potassium ferricyanide can not be widely used because of environmental concerns, iron chloride can not be widely used because of its inconvenience in handling, such as the corrosion of metals, etc., and bromates can not be widely used because of the problem of instability of the processing solution.

Accordingly, a bleaching agent capable of attaining quick bleaching having a good handling property without causing the problem at discharging the waste solution has been desired. Recently, as a bleaching agent meeting such requirements, 1,3-diaminopropanetetraacetic acid ferric complex salt has been disclosed as a bleaching agent.

However, the foregoing bleaching agent has a problem in performance, such as bleach fog forming with bleaching. As a method of reducing the formation of the bleach fog, it is disclosed to add a buffer to the bleach solution as described, e.g., in JP-A-1-213657. However, the improvement level is not sufficiently satisfactory. In particular, since a developer having a high activity is used in quick processing wherein the color development is carried out within 3 minutes, large bleach fog occurs even in the case of using such a buffer.

Furthermore, when the processing solution having a bleaching power containing the 1,3-diaminopropanetetraacetic acid ferric complex salt is used, there occurs a problem that during storing the photographic images after processing, the formation of stain is increased.

Moreover, when continuous processing is carried out using a processing solution having a bleaching power containing the 1,3-diaminopropanetetraacetic acid ferric complex salt, there occur the problems that the desilvering property is greatly lowered as compared with the beginning of continuous processing. Also, precipitates form in the processing solution.

Thus, a novel processing composition having a bleaching power and a processing process, which can be employed without causing the foregoing problems, have been desired.

SUMMARY OF THE INVENTION

The first object of the present invention is, therefore, to provide a photographic processing composition without forming precipitates and sludges by the intermixing of metal ions, and a processing method using the composition.

The second object of the present invention is to provide a stable photographic processing composition without causing a decrease of the effective components in the processing solution and the formation of components giving bad photographic action even by intermixing of metal ions, and a processing method using the composition.

The third object of the present invention is to provide a photographic processing composition capable of preventing lowering of the storage stability of images caused by remaining metal ions of the processing components in the photographic light-sensitive material processed, and a processing method using the composition.

The fourth object of the present invention is to provide a photographic processing composition which can be handled easily and does not cause an environmental problem by the waste solution, and a processing method using the composition.

The fifth object of the present invention is to provide a photographic processing composition having a bleaching power excellent in the desilvering property, and a processing method using the composition.

The sixth object of the present invention is to provide a photographic processing composition having a bleaching power and giving less bleaching fog, and a processing method using the composition.

The seventh object of the present invention is to provide a photographic processing composition having a bleaching power and causing less stains on photographic light-sensitive materials processed over the passage of time, and a processing method using the composition.

The eighth object of the present invention is to provide a photographic processing composition capable of stably keeping the above-described perfomances even in continuous processing, and a method using the composition.

It has now been discovered that the foregoing objects can be achieved by the present invention as described hereinbelow.

That is, according to one embodiment of the present invention, there is provided a photographic processing composition containing at least one kind of a compound represented by following formula (I).

According to another embodiment of the present invention, there is provided a processing process of silver halide photographic material using the foregoing processing composition.

According to still another embodiment of the present invention, there is provided a photographic processing composition for silver halide color photographic material, said composition containing a Fe(III), Mn(III), Co(III), Rh(II), Rh(III), Au(II), Au(III), or Ce(IV) chelate compound of the compound represented by foregoing formula (I).

According to a further embodiment of the present invention, there is provided a processing method for a silver halide color photographic material using the foregoing composition containing the chelate compound.

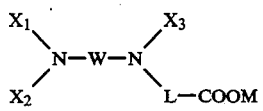

(I)

wherein $X_1$, $X_2$, and $X_3$ each represents a hydrogen atom, —L—COOM, or

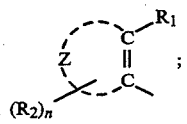

at least one of $X_1$, $X_2$, and $X_3$ represents

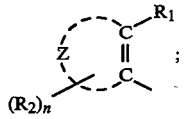

Z represents carbon atomic group necessary for forming an aryl group; $R_1$ represents a hydrogen atom or a substituent group; $R_2$ represents an alkyl group, an alkoxy group, an acytamino group, an alkylsulfonylamino group, an arylsulfonylamino group, a ureido group, an alkoxycarbonylamino group, an aryloxycarbonylamino group, a sulfamoyl group, a carbamoyl group, an alkylthio group, an alkylsulfonyl group, an arylsulfonyl group, an alkylsulfinyl group, an arylsulfinyl group, a hydroxy group, a halogen atom, a cyano group, $—SO_3M^1$, $—COOM^1$, $—PO_3M^1M^2$ group, an acyl group, an alkoxycarbonyl group, an acyloxy group, a nitro group, or a hydroxamic acid group; n represents 0 or an integer of from 1 to 7; L represents an alkylene group; M, $M^1$ and $M^2$ each represents a hydrogen atom or a cation; and W represents a divalent linkage group containing an alkylene group and/or an arylene group.

DETAILED DESCRIPTION OF THE INVENTION

The present invention is now described in detail.

In the present invention a group having an acyl moiety represents a group having an aliphatic acyl moiety or an aromatic acyl moiety, and an aryl group represents a group having a phenyl group or a naphthyl group.

The compound represented by foregoing formula (I) is explained below in detail.

In formula (I), Z represents a carbon atomic group necessary for forming an aryl group. As the aryl group, a monocyclic or dicyclic aryl group is preferred, a phenyl group is more preferable. Examples include a phenyl group and a naphthyl group, and a phenyl group is preferred.

$R_1$ represents a hydrogen atom or a substituent. As the substituent shown by $R_1$, there are an alkyl group, an aralkyl group, an alkenyl group, an alkinyl group, an alkoxy group, an aryl group, an amino group, an acylamino group, an alkylsulfonylamino group, an arylsulfonylamino group, a ureido group, an alkoxycarbonylamino group, an aryloxycarbonylamino group, an aryloxy group, a sulfamoyl group, a carbamoyl group, $—SM^3$, an alkylthio group, an arylthio group, an alkylsulfonyl group, an arylsulfonyl group, an alkylsulfinyl group, an arylsulfinyl group, a hydroxy group, a halogen atom, a cyano group, $—SO_3^{M3}$, $—COOM^3$, $—PO_3M^3M^4$, an aryloxycarbonyl group, an acyl group, an alkoxycarbonyl group, an acyloxy group, a nitro group, a hydroxamic acid group, etc. These groups (except a cyano group, $—SO_3^{M3}$, $—COOM^3$, $—PO^3M^3M^4$, a hydroxy group, a nitro group and a halogen atom) may be further substituted with at least one of these substituents. In the present invention in the ureido group at least one of two hydrogen atoms in the amino group may be substituted. $M^3$ and $M^4$ each has the same meanings as M in formula (I).

In more detail, as the substituent shown by $R_1$, there are an alkyl group (e.g., methyl and ethyl), an aralkyl group (e.g., phenylmethyl), an alkenyl group (e.g., allyl), an alkinyl group (e.g., ethinyl group), an alkoxy group (e.g., methoxy and ethoxy), an aryl group (e.g., phenyl and p-methylphenyl), an amino group (e.g., amino, dimethylamino, and dihydroxyamino), an acylamino group (e.g., acetylamino and benzamido), an alkyl- and aryl-sulfonylamino group (e.g., methanesulfonylamino), a ureido group (e.g., ureido and methylureido), an alkyl- and aryl-oxycarbonylamino group (e.g., methoxycarbonylamino), an aryloxy group (e.g., phenyloxy), a sulfamoyl group (e.g., methylsulfamoyl), a carbamoyl group (e.g., carbamoyl and methylcarbamoyl), a mercapto group, an alkylthio group (e.g., methylthio), an arylthio group (e.g., phenylthio), an alkyl- and aryl-sulfonyl group (e.g., methanesulfonyl), an alkylmethanesulfinyl), and aryl-sulfinyl group (e.g., hydroxy group, a halogen atom (e.g., chlorine, fluorine, and bromine), a cyano group, $—SO_3M^3$ (e.g. $—SO_3H$), $—COO^{M3}$ (e.g. —COOH), $PO_3M^3M^4$ (e.g. $—PO_3H_2$), an aryloxycarbonyl group (e.g., phenyloxycarbonyl), an acyl group (e.g., acetyl and benzoyl), an alkoxycarbonyl group (e.g., methoxycarbonyl), an acyloxy group (e.g., acetoxy), a nitro group, a hydroxamic acid group, etc. When the foregoing substituent has carbon atoms, the carbon atom number (in the present invention the carbon number of a group includes the number of the substituent(s) if the group has any) is preferably from 1 to 10, more preferably from 1 to 4.

The substituent shown by $R_1$ is preferably an alkoxy group, an amino group, an acylamino group, an alkyl- and aryl- sulfonylamino group, an alkoxy- and aryloxy-carbonylamino group, a sulfamoyl group, a carbamoyl group, an alkylthio group, a hydroxy group, $—SO_3M^3$, $—COOM^3$, $—PO_3M^3M^4$, a nitro group, or a hydroxamic acid group, more preferably a hydroxy group, $—SO_3M^3$, $—COOM^3$, or a nitro group, and particularly preferably $—COOM^3$.

$R_2$ represents an alkyl group, an alkoxy group, an acylamino group, an alkylsulfonylamino group, an arylsulfonylamino group, a ureido group, an alkoxycarbonylamino group, an aryloxycarbonylamino group, a sulfamoyl group, a carbamoyl group, an alkylthio group, an arylthio, an alkylsulfonyl group, an arylsulfonyl group, an alkylsulfinyl group, an arylsulfinyl group, a hydroxy group, a halogen atom, a cyano group, $—SO_3M^1$, $—COOM^2$, $—PO_3M^1M^2$, an acyl group, an alkoxycarbonyl group, an acyloxy group, a nitro group, or a hydroxamic acid group. These groups (except a cyano group, $—SO_3M^1$, $—COOM^2$, $—PO_3M^1M^2$, a hydroxy group, a nitro group and a halogen atom) may be substituted by at least one of substituents shown by $R_1$.

In more detail, $R_2$ represents an alkyl group (e.g., methyl and ethyl), an alkoxy group (e.g., methoxy and ethoxy), an acylamino group (e.g., acetylamino), an alkyl- and aryl-sulfonyl amino group (e.g., methanesulfonylamino), a ureido group (e.g., ureido and methylureido), an alkoxy- and aryloxy-carbonylamino group (e.g., methoxycarbonylamino), a sulfamoyl group (e.g., methylsulfamoyl), a carbamoyl group (e.g., carbamoyl and methylcarbamoyl), an alkylthio group (methylthio), an alkyl- and aryl-sulfonyl group (e.g., methanesulfonyl), an alkyl- and aryl-sulfinyl group (e.g., methanesulfinyl), a hydroxy group, a halogen atom (e.g., chlorine, bromine, and fluorine), a cyano group, $—SO_3M^1$ (e.g., $—SO_3H$), $—COOM^2$ (e.g., —COOH), $—PO_3M^1M^2$ (e.g., $—PO_3H^2$), an acyl group (e.g., acetyl and benzyl), an alkoxycarbonyl group (e.g., methoxycarbonyl), an acyloxy group (e.g., acetoxy), a nitro group, or a hydroxamic acid group. When the foregoing substituents have carbon atoms, the carbon atom number is preferably from 1 to 10, more preferably from 1 to 4.

$R_2$ is preferably an alkoxy group, an acylamino group, an alkyl- and aryl- sulfonylamino group, a ureido group, a sulfamoyl group, a carbamoyl group, an alkylthio group, a hydroxy group, $—SO_3M^1$, $—COOM^2$, $—PO_3M^1M^2$, a nitro group, or a hydroxamic acid group, and more preferably a hydroxy group, $—SO_3M1$, $—COOM^2$, or a nitro group.

Also, n represents 0 or an integer of from 1 to 7, preferably an integer of from 0 to 2, more preferably 0 or 1, and particularly preferably 0.

At least one or two of $X_1$, $X_2$ and $X_3$, preferably one or two of them, more preferably one of them represents

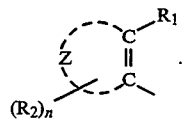

The alkylene group shown by L may be straight chain or branched, and is preferably an alkylene group having from 1 to 6 carbon atoms.

When formula (I) has plural Ls, the plural Ls may be the same or different. Also, L may have at least one substituent, such as those shown by $R_1$. L is preferably methylene or ethylene.

As the cation shown by M, $M^1$, $M^2$, $M^3$ and $M^4$ there are an alkali metal (e.g., lithium, sodium, and potassium), an ammonium (e.g., ammonium and tetraethylammonium), pyridinium, etc.

The divalent linkage group shown by W can be preferably shown by following formula (W);

$$—(W^1\text{-}D)_m—W^2— \quad (W)$$

wherein $W^1$ and $W^2$, which may be the same or different, each represents a straight chain or branched alkylene group (preferably an alkylene group having from 2 to 8 carbon atoms), a cycloalkylene group (preferably a cycloalkylene group having from 5 to 10 carbon atoms), an arylene group (preferably an arylene group having from 6 to 10 carbon atoms), or an aralkylene group (preferably an aralkylene group having from 7 to 10 carbon atoms), and D represents —O—, —S—, $—N(R_w)—$, or a divalent nitrogen-containing heterocyclic group. $R_W$ represents a hydrogen atom, an alkyl group (preferably an alkyl group having from 1 to 8 carbon atoms) or an aryl group (preferably an aryl group having from 6 to 10 carbon atoms) each group may be substituted with $—COOM_2$, $—PO_3M_3M_4$, —OH, or $—SO_3M_5$ (wherein $M_2$, $M_3$, $M_4$, and $M_5$ each has the same meaning as M in formula (I)).

The linkage group shown by W may have at least one substituent at $W^1$, $R_w$ and/or $W^2$ such as the substituent shown by $R_1$. When W has two substituents, they may be bonded to form a 5- or 6-membered condenced ring, for example 5- or 6-membered saturated or unsaturated hydrocarbon ring.

As the divalent nitrogen-containing heterocyclic group, a 5- or 6-membered heterocyclic ring having 1 to 4 hetero atoms that is, at least one nitrogen atom and at least one of nitrogen atom, oxygen atom and sulfur atom, as the hetero atom(s) is preferred. The heterocyclic group which is bonded to $W^1$ and $W^2$ with adjacent carbon atoms in the heterocyclic ring is more preferable.

Examples of the divalent nitrogen-containing heterocyclic group are shown below.

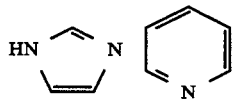

As $W^1$ and $W^2$, an alkylene group having from 2 to 4 carbon atoms is preferred.

In formula (W) described above, m represents an integer of from 0 to 3, and when m is 2 or 3, said ($W^1$-D)s may be the same or different. Furthermore, m is preferably from 0 to 2, more preferably 0 or 1, and particularly preferably 0.

Practical examples of the divalent linkage group shown by formula (W) are illustrated below.

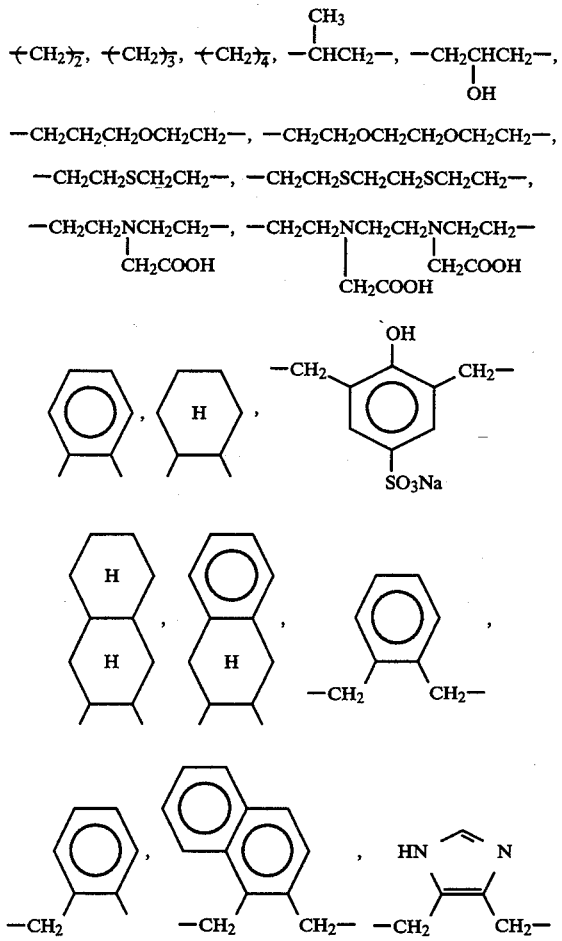

Preferred compounds in the compounds shown by formula (I) described above are the compounds represented by following formula (II) or (III);

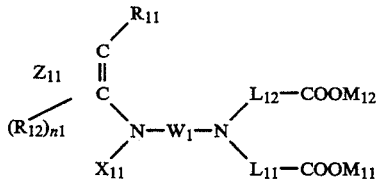

(II)

wherein $X_{11}$ represents a hydrogen atom, $—L_{13}—COOM_{13}$, or

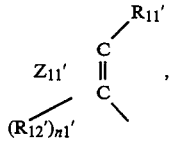

$X_{11}$ is preferably $—L_{13}—COOM_{13}$; $Z_{11}$ and $Z_{11}'$ each has the same meaning as Z in formula (I); $R_{11}$ and $R_{11}'$ each has the same meaning as $R_1$ in formula (I); $R_{12}$ and $R_{12}'$ each has the same meaning as $R_2$ in formula (I); $n_1$ and $n_1'$ each has the same meaning as n in formula (I); $W_1$ has the same meaning as W in formula (I); $L_{11}$, $L_{12}$, and $L_{13}$ each has the same meaning as L in formula (I); and $M_{11}$, $M_{12}$, and $M_{13}$ each has the same meaning as M in formula (I):

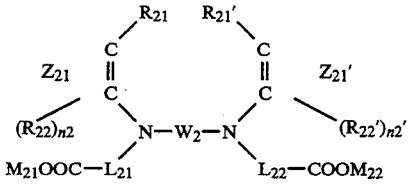

(III)

wherein $Z_{21}$ and $Z_{21}'$ each has the same meaning as Z in formula (I); $R_{21}$ and $R_{21}'$ each has the same meaning as $R_1$ in formula (I); $R_{22}$ and $R'_{22}$ has the same meaning as $R_2$ in formula (I); $n_2$ and $n_2'$ each has the same meaning as n in formula (I); $W_2$ has the same meaning as W in formula (I); $L_{21}$ and $L_{22}$ each has the same meaning as L in formula (I); and $M_{21}$ and $M_{22}$ each has the same meaning as M in formula (I).

In the present invention, the particularly preferred compounds of formula (I) are the compound shown by formula (II) wherein $R_{11}$ is $—COOM_{33}$ (wherein $M_{33}$ has the same meaning as M in formula (I)) and the compound shown by formula (III) wherein $R_{21}$ and $R_{22}'$ each is $—COOM_{43}$ (wherein $M_{43}$ has the same meaning as M in formula (I)). The most preferred compounds are those which are shown by formula (II) wherein $R_{11}$ represents $—COOM_{33}$ and $X_{11}$ represents $—L_{13}COOM_{13}$.

Specific examples of the compound represented by formula (I) are illustrated below but the invention is not limited to these compounds.

1.

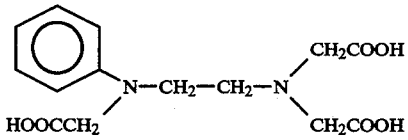

2.

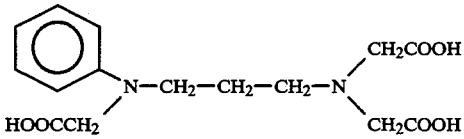

3.

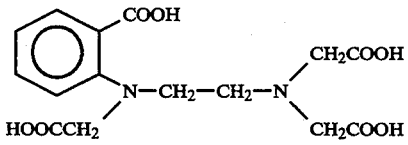

4.

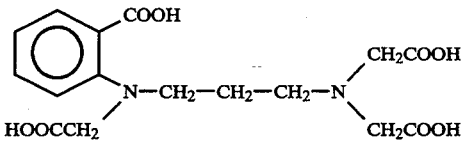

-continued
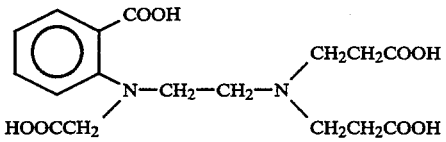
5.
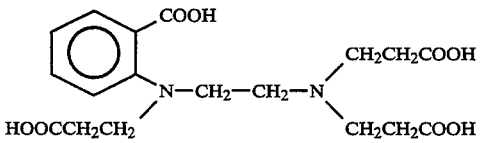
6.
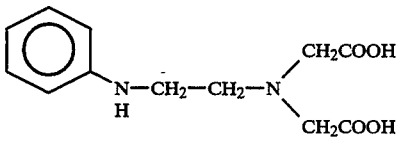
7.
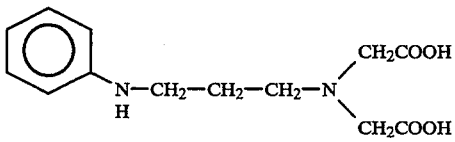
8.
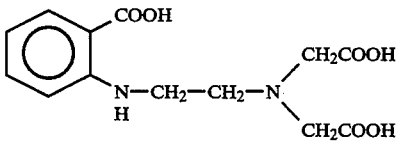
9.
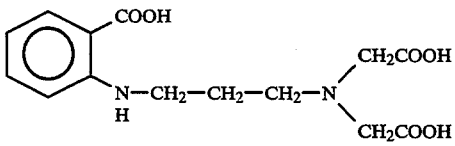
10.
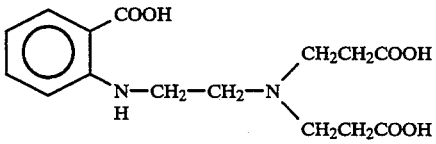
11.
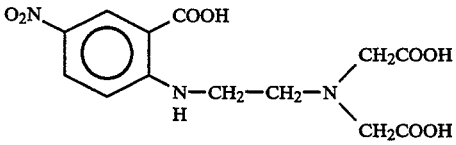
12.
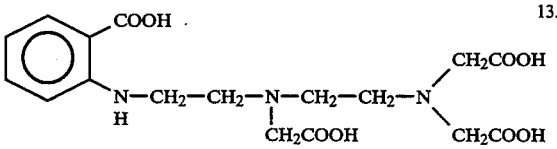
13.
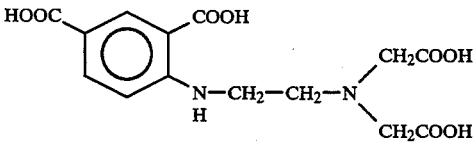
14.
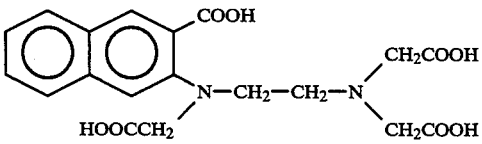
15.
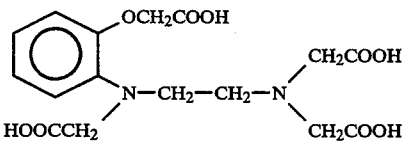
16.
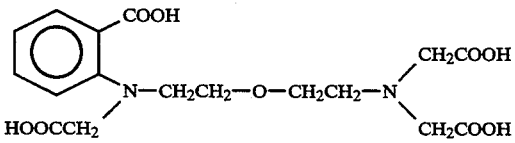
17.
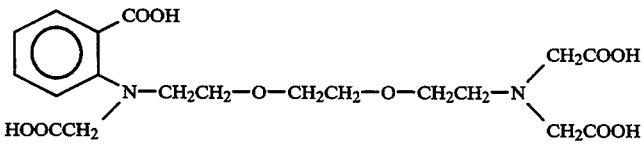
18.
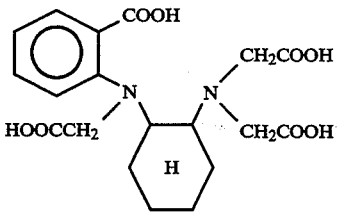
19.
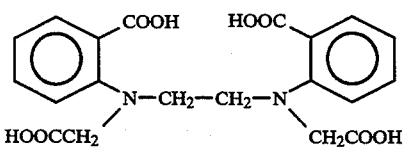
20.

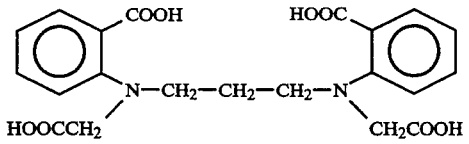
-continued
21.
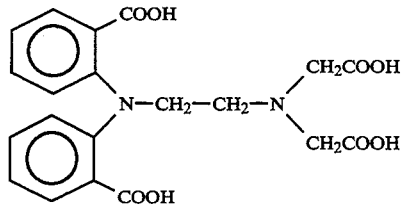
22.
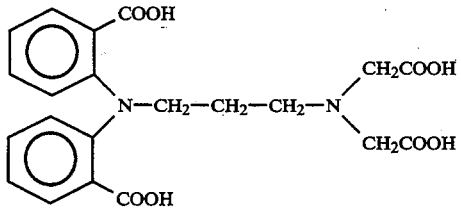
23.
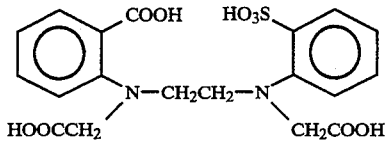
24.
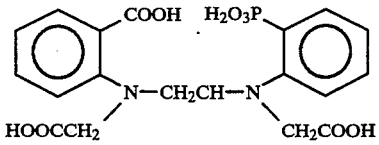
25.
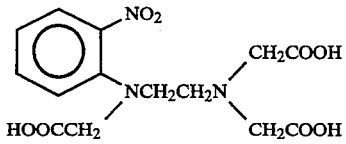
26.
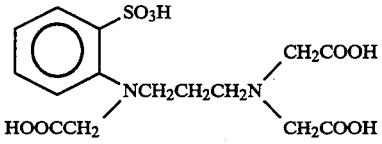
27.
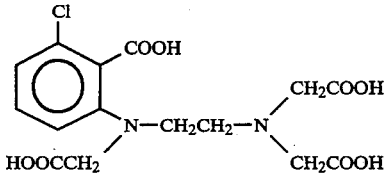
28.
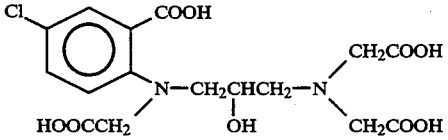
29.
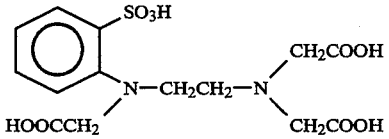
30.
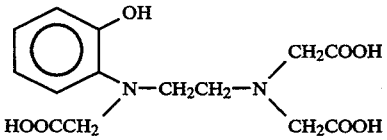
31.
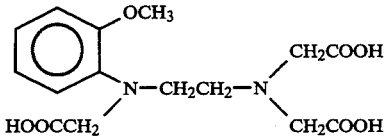
32.
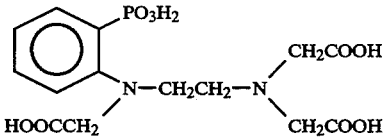
33.
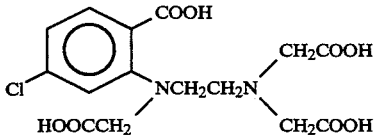
34.
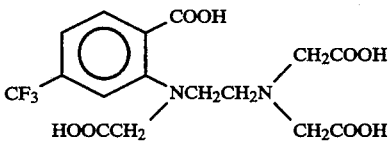
35.
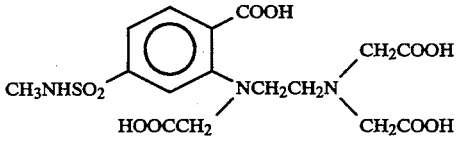
36.
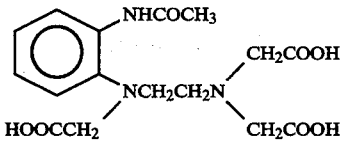
37.
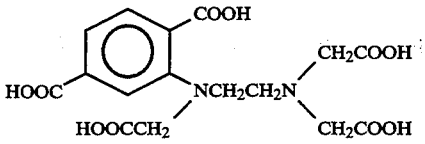
38.

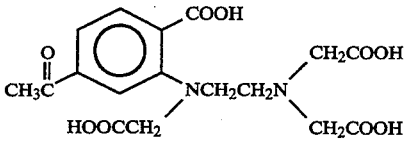
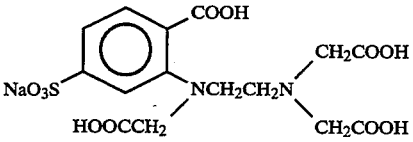
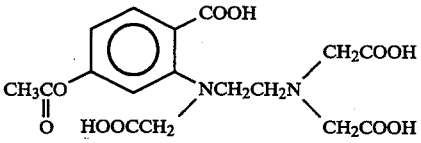
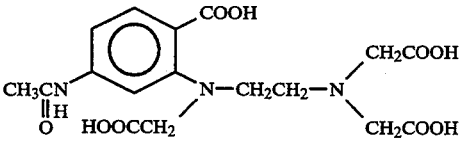
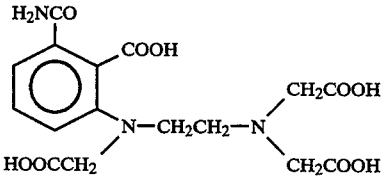
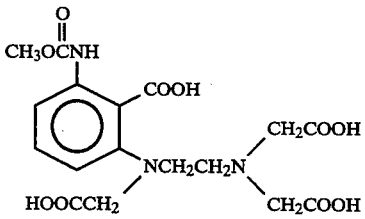
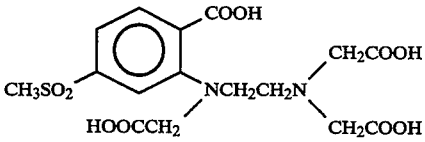
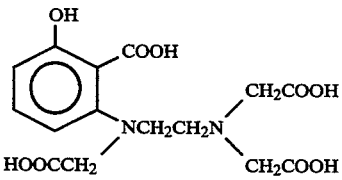
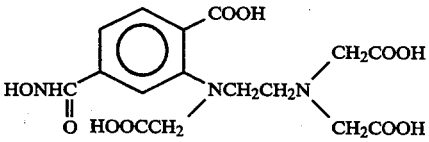
-continued
39.
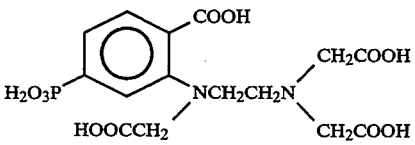
40.
41.
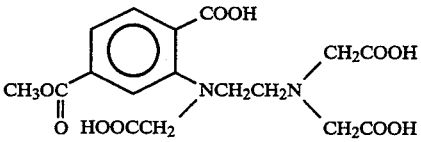
42.
43.
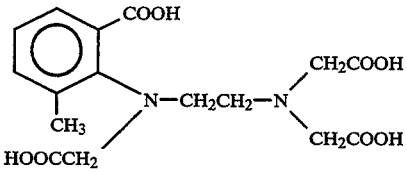
44.
45.
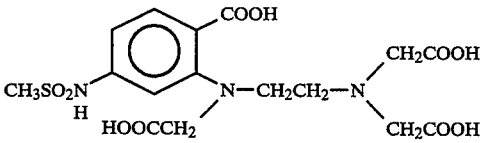
46.
47.
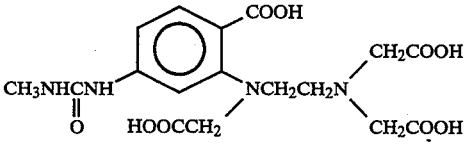
48.
49.
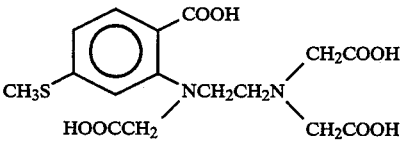
50.
51.
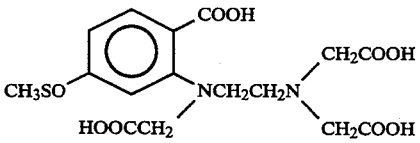
52.
53.
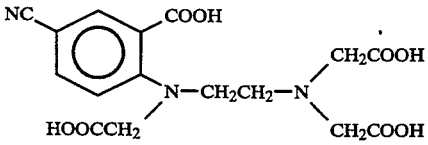
54.
55.
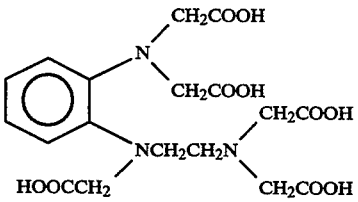
56.

Next, typical synthesis examples of the compounds shown by formula (I) for use in the present invention are shown below.

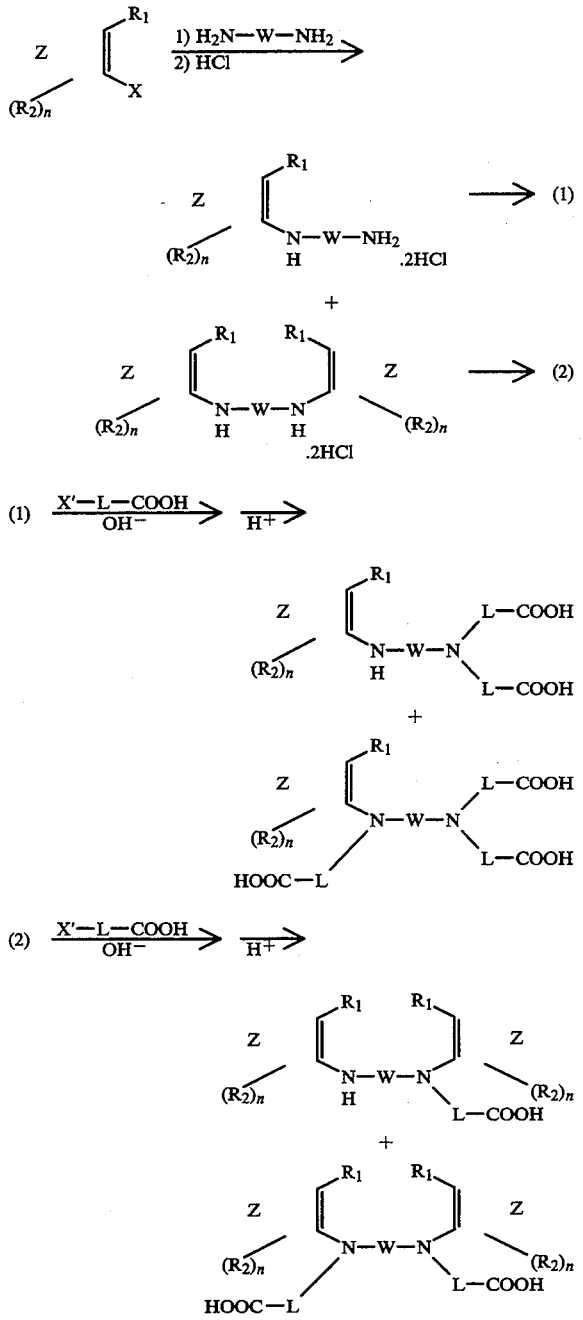

X, X': Halogen atom (such as F, Cl, Br and I) L, $R_1$, $R_2$, n, M, W and Z are same as in formula (I).

That is, the compound shown by formula (I) can be obtained by substituting the halogen atom of the halogen-substituted aromatic derivative with a diamine derivative, reacting the compound thus obtained with an inorganic acid (preferably hydrochloric acid) and reacting the compound thus obtained with a halogen-substituted alkylcarboxylic acid. Compounds which are used in these reactions can be commercially obtained.

For the reaction of the halogen-substituted aromatic derivative and the diamine derivative, it is preferred to use an alkali and a catalyst. Example of the alkali being used for the reaction are potassium carbonate and sodium carbonate. Examples of the catalyst are a copper powder, CuCl, CuBr, CuI, and CuO.

For the reaction, a solvent may be used or may not be used. In the case of using a solvent, any solvents which do not take part in the reaction can be used. Examples of the solvent are alcohols (e.g., methanol, ethanol, isopropanol, butanol, and pentanol), dioxane, and dimethylformamide.

Also, for the reaction of the halogen-substituted alkylcarboxylic acid, it is preferred to use a solvent. In this case, there is no particular restriction on the solvent being used if the solvent does not take part in the reaction. Examples of the solvent are water alcohols (e.g., methanol, ethanol and isopropanol) and dioxane. Also, it is preferred to use a base for the reaction. Examples of the base are sodium hydroxide, potassium hydroxide, tertiary amines (e.g., triethylamine), and pyridine.

SYNTHESIS OF EXAMPLE 1

Synthesis of Compound 3:

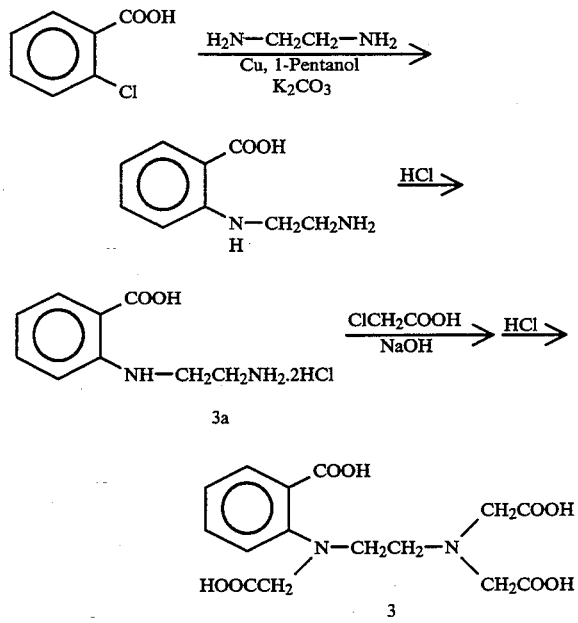

Synthesis of Compound 3a

In 68 ml of 1-pentanol were suspended 31.4 g ($2.01\times10^{-1}$ mol) of o-chlorobenzoic acid, 25.6 g ($1.85\times10^{-1}$ mol) of potassium carbonate (used to neutralize the acid produced by the reaction), and 32 ml ($4.79\times10^{-1}$ mol) of ethylenediamine and after adding thereto 0.3 g ($4.72\times10^{-3}$ mol) of a copper powder (Cica: the first class agent produced by Kantokagaku Co., Ltd.), the resultant mixture was heat-refluxed for 5 hours. Then, 200 ml of water was added to the reaction mixture and the solvent was removed by azeotropic distillation. While the reaction mixture was hot, the reaction mixture was filtered and after cooling the filtrate, the pH thereof was adjusted to 7.8 with a hydrochloric acid aqueous solution ($H_2O$: conc.HCl=1:1 volume ratio) . Then, precipitates formed were recovered by filtration and washed with 200 ml of ethanol. The precipitates were dissolved in a hot hydrochloric acid aqueous solution ($H_2O$:conc.HCl=1:1 volume ratio) followed by filtration (while the mixture was hot) and the solution was cooled. Precipitates formed were recovered by filtration, placed in a beaker, and after adding thereto 100 ml of water, 100 ml of 28% aqueous ammonia and 0.5 g of active carbon, the mixture was stirred well.

The solution was filtered and the pH of the filtrate was adjusted to 1.6 with concentrated hydrochloric acid. Precipitates thus formed were recovered by filtration, washed with water, and dried to provide 15.7 g ($5.99\times10^{-2}$ mol) of gray crystals of Compound 3a. The yield was 30%.

A method for production 3a is also disclosed in Allen Young and Thomas R. Sweet, *J. Amer. Chem. Soc.*, 80., 800 (1958).

Synthesis of Compound 3:

In 30 ml of water were suspended 4.9 g ($1.94\times10^{-2}$ mol) of Compound 3a prepared in the above step and 10.0 g ($1.06\times10^{-1}$ mol) of chloroacetic acid. Then, 55 ml (0.275 mol) of an aqueous 5N sodium hydroxide solution was gradually added to the suspension to keep the pH thereof at 9 to 11. Then, the mixture was stirred for 5 hours at an inside temperature of 60° C. and for 3 hours at 90° C. After cooling, the reaction mixture was placed in a beaker and the pH thereof was adjusted to 1 with concentrated hydrochloric acid. Precipitates thus formed were recovered by filtration, placed in a beaker again, and 100 ml of water was added thereto. Then, after adjusting the pH to 4 by the addition of an aqueous 5N sodium hydroxide solution, the solution formed was filtered and the pH of the filtrate was adjusted to 1.6 with concentrated hydrochloric acid. Precipitates thus formed were recovered by distillation, washed with water, and dried under reduced pressure to provide 2.8 g ($7.90\times10^{-3}$ mol) of white crystals of Compound 3. The yield thereof was 41% and the melting point was 222° C. to 224° C. (decomposed).

| Elemental analysis for $C_{15}H_{18}N_2O_8$: | | | |
|---|---|---|---|
| | H | C | N |
| Calculated: | 5.12% | 50.85% | 7.81% |
| Found: | 5.13% | 50.79% | 7.88% |

$^1$HNMR ($D_2O$+NaOD) δppm δ 2.67 (t 2H), δ 3.12 (s 4H), δ 3.23 (t 2H), δ 3.68 (s 2H), δ 6.93–7.01 (m 2H), δ 7.25–7.40 (m 2H)

SYNTHESIS EXAMPLE 2

Synthesis of Compound 4

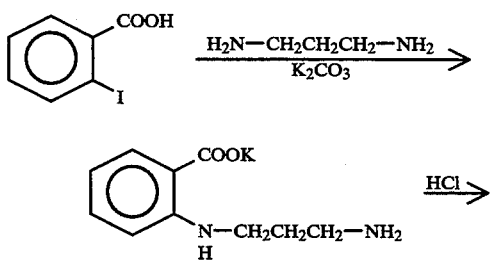

-continued

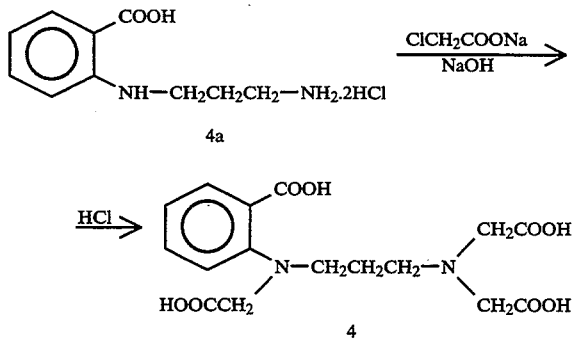

Synthesis of Compound 4a

In 166 g (2.24 mols) of 1,3-propanediamine were suspended 25.3 g (0.102 mol) of o-iodobenzoic acid and 17.0 g (0.123 mol) of potassium carbonate, and the suspension was heat-refluxed for 15 hours. Then, 30 ml of water was added to the reaction mixture, after distilling off the solvent under reduced pressure, 150 ml of water was added to the residue, and the mixture was placed in a beaker. After adjusting the pH thereof to 1 with concentrated hydrochloric acid, crystals formed were recovered by filtration and dried to provide 6.25 g ($2.34\times10^{-2}$ mol) of white crystals of compound 4a. The yield was 23%.

A method for production of 4a is also disclosed in the same literature as that for 3a.

Synthesis of Compound 4

In 50 ml of water were added 6.2 g ($2.34\times10^{-2}$ mol) of Compound 4a obtained in the above step and 15.0 g ($1.59\times10^{-1}$ mol) of chloroacetic acid, and a solution of 9.17 g ($2.29\times10^{-1}$ mol) of sodium hydroxide dissolved in 50 ml of water was added dropwise to the mixture to keep the pH thereof to 9 to 11. Then, the mixture was stirred for 3 hours at an inside temperature of 60° C., and then for 3 hours at 90° C. After cooling, the reaction mixture was placed in a beaker, the pH thereof was adjusted to 1.6 with concentrated hydrochloric acid, and the reaction mixture was allowed to stand in a refrigerator. After two weeks crystals deposited were recovered by filtration and dried to provide 3.7 g ($1.00\times10^{-2}$ mol) of the white crystals of Compound 4. The yield was 43% and the melting point was 167° C. to 170° C.

| Elemental Analysis for $C_{16}H_{20}N_2O_8$: | | | |
|---|---|---|---|
| | H | C | N |
| Calculated: | 5.47% | 52.17% | 7.61% |
| Found: | 5.35% | 52.08% | 7.57% |

$^1$HNMR ($D_2O$+NaOD) δppm δ 1.95 (m 2H), δ 3.22 (t 2H), δ 3.53 (t 2H), δ 3.68 (s 4H), δ 3.98 (s 2H), δ 7.2–7.9 (m 4H)

SYNTHESIS EXAMPLE 3

Synthesis of Compound 9

In 100 ml of water were suspended 103 g ($4.07\times10^{-1}$ mol) of Compound 3a synthesized in Synthesis Example 1 and 112 g ($9.62\times10^{-1}$ mol) of chloroacetic acid and a solution of 82 g (2.05 mols) of sodium hydroxide dissolved in 100 ml of water was gradually added to the suspension to keep the pH thereof to 9 to 11. Then, the mixture was stirred for 5 hours at an inside temperature of from 55° C. to 60° C. After cooling, precipitates formed were recovered by filtration and dissolved in 200 ml of water. Then, while cooling the solution with ice bath, the pH thereof was adjusted to 3.6 with concentrated hydrochloric acid. After stirring the mixture for about 30 minutes, precipitates formed were recovered by filtration, washed with water, and dried under reduced pressure to provide 38 g ($1.12\times10^{-1}$ mol) of white crystals. The yield was 27% and the melting point was 185° C. (gradually decomposed).

| Elemental Analysis for $C_{13}H_{14}N_2Na_2O_6$: | | | |
|---|---|---|---|
| | H | C | N |
| Calculated: | 4.15% | 45.89% | 8.23% |
| Found: | 4.32% | 45.54% | 8.28% |

$^1$HNMR ($D_2O$+NaOD) δppm δ 2.93 (t 2H), δ 3.35 (s 4H), δ 3.37 (t 2H), δ 6.70 (t 1H), δ 6.82 (d 1H), δ 7.35 (t 1H), δ 7.71 (d 1H)

SYNTHESIS EXAMPLE 4

Synthesis of Compound 11

In 50 ml of water was added 30 g ($1.19\times10^{-1}$ mol) of Compound 3a to obtain a suspension and an aqueous solution of 28 g ($7.0\times10^{-1}$ mol) of sodium hydroxide dissolved in 100 ml of water was added to the suspension. Furthermore, after adding thereto 27 ml ($3.94\times10^{-1}$ mol) of acrylic acid, the resultant mixture was stirred for 4 hours at 60° C. After cooling the reaction mixture, the pH thereof was adjusted to 2 to 3 with concentrated hydrochloric acid. After stirring, the mixture was allowed to stand to separate into an upper layer and a lower layer. The upper layer was removed and 200 ml of water was added to the remaining lower layer. The mixture was stirred well. Precipitates formed were recovered by filtration, washed with water, and dried under reduced pressure to provide 23 g ($7.09\times10^{-2}$ mol) of white crystals. The yield was 60% and the melting point was 183° C. to 185° C.

| Elemental Analysis for $C_{15}H_{20}N_2O_6$: | | | |
|---|---|---|---|
| | H | C | N |
| Calculated: | 6.21% | 55.55% | 8.64% |
| Found: | 6.14% | 55.38% | 8.54% |

$^1$HNMR ($D_2O$+NaOD) δppm δ 2.40 (t 4H), δ 2.77 (t 2H), δ 2.82 (t 4H), δ 3.48 (t 2H), δ 6.77 (t 1H), δ 6.89 (d 1H), δ 7.40 (t 1H), δ 7.77 (d 1H)

SYNTHESIS EXAMPLE 5

Synthesis of Compound 12

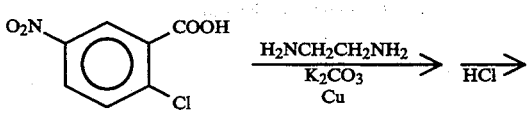

-continued

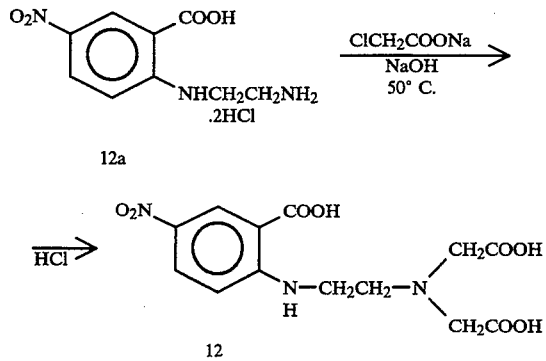

Synthesis of Compound 12a

In 50 ml of methanol was suspended 20.2 g (0.10 mol) of 2-chloro-5-nitrobenzoic acid and after adding thereto 60.1 g (1.0 mol) of ethylenediamine, 40.0 g (0.29 mol) of potassium carbonate, and 0.30 g ($4.7\times10^{-3}$ mol) of a copper powder (the same as used hereinbefore), the resultant mixture was refluxed for 6 hours. Then, 50 ml of water was added to the reaction mixture and after filtering, the solvent was distilled off from the filtrate under reduced pressure. Furthermore, 100 ml of water was added to the residue and the pH of the solution was adjusted to 1 with concentrated hydrochloric acid. After cooling the solution with an ice bath, precipitates formed were recovered by filtration, washed with water and then methanol, and dried under reduced pressure to provide 23.0 g ($7.71\times10^{-2}$ mol) of yellow crystals. The yield was 77%.

Synthesis of Compound 12

In 30 ml of water was suspended 16.4 g ($5.5\times10^{-2}$ mol) of Compound 12a obtained in the above step and after adding thereto 6.6 g ($1.65\times10^{-1}$ mol) of sodium hydroxide and 30 ml of water, the inside temperature of the mixture was kept at 50° C. Then, an aqueous solution of 14.1 g ($1.21\times10^{-1}$ mol) of chloroacetic acid dissolved in 30 ml of water was added to the reaction mixture obtained and further 4.9 g ($1.22\times10^{-1}$ mol) of sodium hydroxide and 25 ml of water were added to the reaction mixture such that the pH thereof was kept at 9 to 11. After stirring 4 hours, the reaction mixture was ice-cooled and the pH thereof was adjusted to 1 with concentrated hydrochloric acid. The precipitates formed were recovered by filtration, placed in a beaker, and 50 ml of water was added thereto. Then, the pH of the solution was adjusted to 12 with an aqueous solution of 48.9% of sodium hydroxide aqueous solution and after filtering the solution, the pH of the filtrate was adjusted to 1 with concentrated hydrochloric acid. After heat-refluxing the solution for one hour, the solution was cooled to room temperature and crystals thus deposited were recovered by filtration and dried under reduced pressure to provide 10.4 g ($2.97\times10^{-2}$ mol) of yellow crystal of Compound 18.$\frac{1}{2}H_2O$. The yield thereof was 54% and the melting point was about 206° C. (gradually decomposed).

| Elementary Analysis for $C_{13}H_{15}N_3O_8.\frac{1}{2}H_2O$: | | | |
|---|---|---|---|
| | H | C | N |
| Calculated: | 4.60% | 44.58% | 12.00% |

-continued

| Elementary Analysis for $C_{13}H_{15}N_3O_8 \cdot \frac{1}{2}H_2O$: | | | |
|---|---|---|---|
| | H | C | N |
| Found: | 4.58% | 44.61% | 11.94% |

$^1$HNMR ($D_2O$+NaOD) δppm δ 2.98 (t 2H), δ 3.37 (s 4H), δ 3.51 (t 2H), δ 6.77 (d 1H), δ 8.11 (dd 1H), δ 8.60 (d 1H)

Methods for production of Compound 20 is disclosed in Ber., 28, 1686 (1985) and J. Phys. Chem., 61, 694 (1957).

Other compounds can be also similarly synthesized.

The compound represented by formula (I) can be applied to all sorts of processing compositions for processing silver halide black and white photographic materials or silver halide color photographic materials.

For example, as processing compositions for black and white photographic materials to which the foregoing compound can be applied, there are an ordinary black and white developer, an infectious developer for lith films, a fixing solution, wash water, etc., and as processing solutions for color photographic materials, there are a color developer, a bleaching solution, a fixing solution, a blix solution, a compensating solution, a stop solution, a hardening solution, wash water, a stabilization solution, a rinse solution, a fogging solution, a toner, etc., but the processing composition to which the compound of formula (I) can be applied is not limited to the aforesaid compositions.

The addition amount of the compound shown by formula (I) depends upon the kind of the processing composition to which the composition is added but is generally used in the range of from 10 mg to 50 g per liter of the processing composition.

More practically, in the case of adding the compound to a black and white developer or a color developer, a preferred amount thereof is from 0.5 g to 10 g, and particularly from 0.5 g to 5 g per liter of the developer.

Also, in the case of adding the compound to a bleaching solution (containing, e.g., hydrogen peroxide, persulfate, bromic acid, etc.), the amount is preferably from 0.1 g to 20 g, and particularly preferably from 0.1 g to 5 g per liter of the bleach solution.

In the case of adding the compound to a fixing solution or a blix solution, the amount is preferably from 1 g to 40 g, and particularly preferably from 1 g to 20 g per liter of the processing solution.

Also, in the case of adding to a stabilization solution, the amount is preferably from 50 mg to 1 g, and particularly preferably from 50 mg to 300 mg per liter of the stabilization solution.

The compounds shown by formula (I) may be used alone or as a combination thereof.

By forming a metal chelate compound of the compound shown by formula (I) and a salt of a metal selected from Fe(III), Mn(III), Co(III), Rh(II), Rh(III), Au(II), Au(III) and Ce(IV), the compound has an effect as a bleaching agent for silver halide color photographic materials.

According to the embodiment of the processing composition containing the metal chelate compound of the present invention, by color developing an imagewise exposed silver halide color photographic material and thereafter processing the color photographic material with a processing composition containing at least the metal chelate compound of the present invention, bleaching of developed silver is carried out very quickly without causing severe bleaching fog occurred in the case of using a conventional bleaching agent capable of carrying out quick bleaching. The effect is particularly remarkable when processing with the processing composition containing the metal chelate compound of the present invention subsequent to a quick color development of a processing time of 3 minutes or shorter. Also, in this case, the storage stability of color images after processing is good and thus it is preferred to handle the processed color images.

The metal salt constituting the metal chelate compound for use in this invention is the salt of a metal selected from Fe(III), Mn(III), Co(III), Rh(II), Rh(III), Au(II), Au(III) and Ce(IV), preferably the salt of Fe(III), Mn(III) or Ce(IV), and particularly preferably the salt of Fe(III). The Fe(III) chelate compound is preferable because it can be easily make to exhibit the function to obtain the effects of the present invention, there is less problem with respect to coloring, it is easily available and cheap, and it has excellent aging stability.

The metal chelate compound for use in the present invention may be formed in a solution by reacting the compound shown by formula (I) and the foregoing metal salt (e.g., ferric sulfate, ferric chloride, ferric nitrate, ammonium ferric sulfate, and ferric phosphate) in the solution.

The molar ratio of the compound shown by formula (I) to the metal ion is at least 1.0. The ratio is preferably as large as possible in the case that the stability of the metal chelate compound is low, and is usually used in the range of from 1 to 30.

Also, the metal chelate compound may be used as an isolated metal chelate compound.

Next, the specific examples of the metal chelate compound for use in the present invention are illustrated below but the invention is not limited to these compounds. In this invention,in the processing solution the compound shown by formula (I) and the metal salt may be presented, alternatively the metal complex set thereof may be presented.

K-1

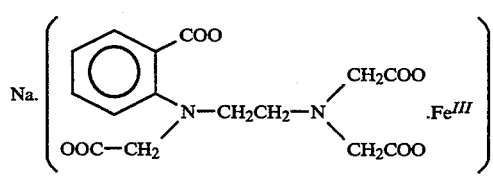

K-2

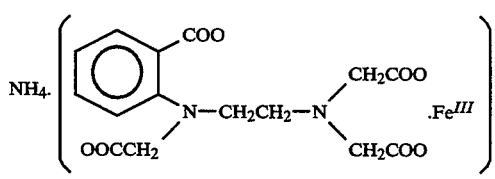

K-3

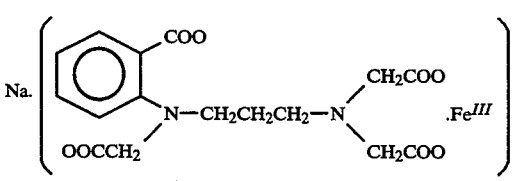

-continued

K-4

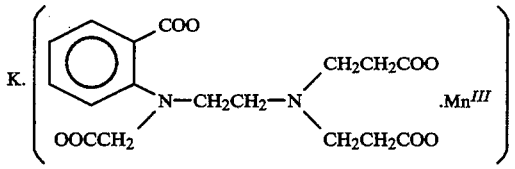

K-5

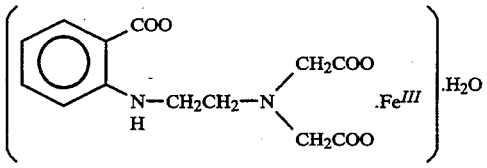

K-6

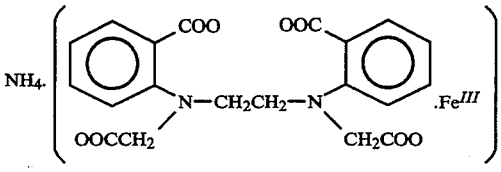

K-7

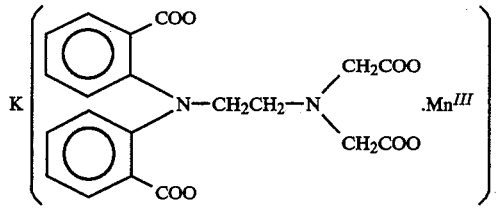

K-8

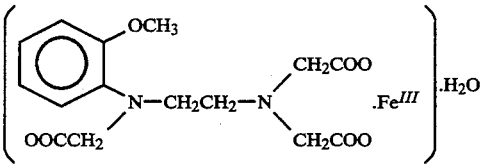

K-9

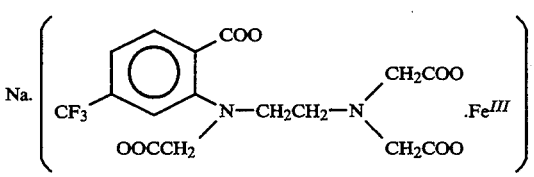

K-10

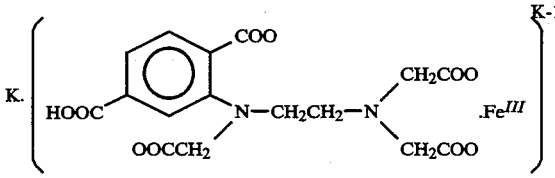

Next, a typical example of the synthesis method for the metal chelate compound salt for use in this invention is shown below.

SYNTHESIS EXAMPLE 6

Synthesis of Compound K-2

In 200 ml of water were suspended 40.4 g (0.100 mol) of ferric nitrate-9H20 and 37.2 g (0.105 mol) of Compound 3, and the pH thereof was adjusted to 5.0 by the addition of an aqueous 29% ammonia solution. After filtering with a glass filter, the filtrate was concentrated at reduced pressure into a volume of about 50 ml. Salts thus deposited were filtered away and the filtrate was concentrated again under reduced pressure into a volume of about 30 ml. After filtering away salts deposited, ethanol was added to the filtrate, thereby brown solids were deposited. Crude crystals thus obtained were recrystallized from water/ethanol and the crystals formed were dried under reduced pressure at room temperature to provide 16.3 g (0.038 mol) of Compound K-2. The yield was 38%.

The metal chelate compound for use in this invention may be incorporated in a fixing solution or an intermediate bath between a color development and a desilvering step in a small amount (preferably 1 m mol/l to 0.01 mol/l; in order to accelarate a rapid process) thereof, but by adding from 0.01 to 1 mol of the metal chelate compound per liter of a processing solution, the compound is effective as a bleaching agent for a bleaching solution or a blixing solution.

Next, a processing solution having a preferred bleaching ability (including a bleaching solution and a blix solution) is explained.

The metal chelate compound for use in this invention is effective as a bleaching agent for the processing solution having a bleaching ability when the solution contains the compound in an amount of from 0.01 to 1 mol per liter of the solution as described above, and the amount of the metal chelate compound is more preferably from 0.05 to 0.5 mol, and particularly preferably from 0.1 to 0.5 mol per liter of the processing solution.

When the metal chelate compound in this invention is used as a bleaching agent for the processing solution having a bleaching ability, the compound may be used together with another known bleaching agent in a range of giving the effect of the present invention. As such a known bleaching agent, there are the Fe(III), Co(III), or Mn(III) chelate bleaching agents of the compounds shown below and persulfates (e.g., peroxodisulfate), hydrogen peroxide, bromates, etc.

That is, as the compound for forming the foregoing chelate bleaching agent, there are ethylenediaminetetraacetic acid, diethylenetriaminepentaacetic acid, ethylenediamine-N-(β-hydroxyethyl)-N,N',N'-triacetic acid, 1,2-diaminopropanetetraacetic acid, 1,3-diaminopropanetetraacetic acid, nitrilotriacetic acid, cyclohexanediaminetetraacetic acid, iminodiacetic acid, dihydroxyethylglycine, ethyl ether diaminetetraacetic acid, glycol ether diaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, and the sodium salts and ammonium salt thereof.

It is preferred that the processing solution containing the metal chelate compound for use in this invention as a bleaching agent and having a bleaching ability further contains a halide, such as a chloride, a bromide, an iodide, etc., as a rehalogenating agent for accelerating the oxidation of silver. Also, the processing solution may contain an organic ligand forming a sparingly soluble silver salt in place of the halide. The halide is added to the processing solution as an alkali metal salt, an ammonium salt, or a salt of guanidine, amine, etc. Practically, there are sodium bromide, ammonium bromide, potassium chloride, guanidine hydrochloride, etc., and ammonium bromide or sodium bromide is preferable. In the bleach solution, the amount of the rehalogenating agent is properly not more than 2 mols/liter, preferably from 0.01 to 2.0 mols/liter, and more preferably from 0.1 to 1.7 mols/liter.

The blix solution containing the metal chelate compound for use in this invention further contains a fixing agent (shown below) and, if necessary, can further contain the foregoing rehalogenating agent. In the case of using the rehalogenating agent in the blix solution, the amount thereof is from 0.001 to 2.0 mols/liter, and preferably from 0.001 to 1.0 mol/liter.

The bleach solution or the blix solution being used in the present invention may, if necessary, contain a bleach accelerator, a corrosion inhibitor inhibiting the corrosion of the processing bath, a buffer for keeping the necessary pH of the solution, an optical whitening agent, a defoaming agent, etc.

As the bleach accelerator which can be used in this invention, there are the compounds having a mercapto group or a disulfide group described in U.S. Pat. No. 3,893,858, West German Patent 1,290,812, U.S. Pat. No. 1,138,842, JP-A-53-95630, and *Research Disclosure*, No. 17129 (1978); the thiazolidine derivatives described in JP-A-50-140129; the thiourea derivative described in U.S. Pat. No. 3,706,561; the polyethylene oxides described in West German Patent 2,748,430; the polyamine compounds described in JP-B-45-8836; and the imidazole compounds described in JP-A-49-40493. Of these compounds, the mercapto compounds described in U.S. Pat. No. 1,138,842 are preferable.

Also, as the corrosion inhibitor, a nitrate is preferably used and ammonium nitrate, sodium nitrate, potassium nitrate, etc., is used. The addition amount thereof is from 0.01 to 2.0 mols/liter, and preferably from 0.05 to 0.5 mol/liter.

In the bleach solution or the blix solution for use in this invention, the ammonium ion concentration can be reduced to 0.3 mol/liter or lower. This embodiment is preferable from the view point of the environmental preservation and, if necessary, in the present invention the concentration can reduced to 0.1 mol/liter or lower.

The pH of the bleach solution or the blix solution in this invention is from 2.0 to 8.0, and preferably from 3.0 to 7.5. In a color photographic material for photographing, when the photographic material is bleached or blixed immediately after color development, it is better to use the processing solution at a pH of 7.0 or lower, and preferably 6.4 or lower. In particular, in the case of the bleach solution, the pH thereof is preferably from 3.0 to 5.0. If the pH is lower than 2.0, the metal chelate compound in this invention becomes unstable and hence the pH of the processing solution is preferably from 2.0 to 6.4. Also, in the case of color print materials, the pH of the processing solution is preferably in the range of from 3 to 7.

For the purpose, as the pH buffer, any buffers which are reluctant to be oxidized with the bleaching agent and show a buffer action in the foregoing pH range can be used. Examples thereof are organic acids, such as acetic acid, glycolic acid, lactic acid, propionic acid, butyric acid, malic acid, chloroacetic acid, levulinic acid, ureidopropionic acid, etc.; and organic bases, such as pyridine, dimethylpyrazole, 2-methyl-o-oxazoline, aminoacetonitrile, etc. These buffers may be used alone or in combination thereof. In the present invention, an organic acid having a pKa of from 2.0 to 5.5 is preferably used as the buffer and, in particular, the use of acetic acid and/or glycolic acid is preferred.

The amount of the buffer is properly 3.0 mols or less, and preferably from 0.5 to 2.0 mols per liter of the processing solution having a bleaching ability.

For controlling the pH of the processing solution having the bleaching ability in the foregoing range, an alkali agent (e.g., aqueous ammonia, potassium hydroxide, sodium hydroxide, imidazole, monoethanolamine, and diethanolamine) may be used together with the foregoing acid. In these materials, aqueous ammonia is preferable.

It is preferable that at processing, an aeration is applied to the processing solution having a bleaching ability to oxidize the iron(II) complex salt formed, thereby the bleaching agent is regenerated and the photographic performance is kept very stably.

The bleaching step or the blixing step is carried out in the temperature range of from 30° C. to 60° C., and preferably from 35° C. to 50° C.

The processing time of the bleaching and/or the blixing step is in the range of from 10 seconds to 7 minutes, and preferably from 10 seconds to 2 minutes in a light-sensitive material for photographing. Also, the processing time thereof is from 5 seconds to 70 seconds, preferably from 5 seconds to 60 seconds, and more preferably from 10 seconds to 45 seconds in a photographic light-sensitive material for printing. In these preferred processing conditions, good results of quick processing and having no increase of stains are obtained.

For the blix solution or the fix solution, a known fixing agent may be used. As the fixing agent, there are thiosulfates, thiocyanates, thioethers, amines, mercaptos, thiones, thioureas, iodides, mesoions, etc. Practical examples thereof are ammonium thiosulfate, sodium thiosulfate, potassium thiosulfate, guanidine thiosulfate, potassium thiocyanate, dihydroxyethyl thioether, 3,6-dithia-1,8-octanediot, and imidazole. In these materials, thiosulfates, in particular, ammonium thiosulfate is preferred for carrying out quick fixing. Furthermore, by using two or more kinds of the fixing agents, more quick fixing can be carried out. For example, a combination of ammonium thiosulfate and foregoing ammonium thiocyanate, imidazole, thiourea, thioether, etc., can be preferably used, and in this case, as the secondary fixing agent, it is preferred to use the secondary fixing agent in the range of from 0.01 to 100 mol % to ammonium thiosulfate.

The amount of the fixing agent is from 0.1 to 3.0 mols, and preferably from 0.5 to 2.0 mols per liter of the blix solution or the fixing solution. The pH of the fixing solution depends upon the kind of the fixing agent but is generally from 3.0 to 9.0. In particular, in the case of using a thiosulfate, the pH of the fix solution is preferably from 6.5 to 8.0 for obtaining a stable fixing performance.

The blix solution or the fixing solution can contain a preservative for increasing the stability of the solution with the passage of time. In the case of a blix solution or a fixing solution containing a thiosulfate, sulfites and/or hydroxylamine, hydrazine, bisulfite addition products of an aldehyde (e.g., bisulfite addition products of acetaldehyde and, particularly preferably, the bisulfite addition products of aromatic aldehydes described in JP-A-1-298935), etc., are effective as the preservatives. Also, the sulfinic acid compounds described in JP-A-62-143048 are preferably used as the preservatives.

Also, for keeping the pH of the blix solution or the fixing solution at a constant value, it is preferable to add a buffer to the solution. Examples of the buffer are phosphates; imidazoles such as imidazole, 1-methylimidazole, 2-methyl-imisdazole, 1-ethyl-imidazole, etc., triethanolamine; N-allylmorpholine; and N-benzoylpiperazine.

Furthermore, in the fixing solution, the stability of the solution can be improved by adding thereto various chelating agents to mask iron ions carried in from a bleaching solution. Examples of preferred chelating agent are 1-hydroxyethylidene-1,1diphosphonic acid, ethylenediamine-N,N,N',N'-tetramethylenephosphonic acid, nitrilotrimethylenephosphonic acid, ethylenediaminetetraacetic acid, diethylenetriaminepentaacetic acid, cyclohexanediaminetetraacetic acid, 1,2-propanediaminetetraacetic acid, and the compound shown by foregoing formula (I) for use in the present invention.

The fixing step is carried out in the temperature range of from 30° C. to 60° C., and preferably from 35° C. to 50° C.

The processing time for the fixing step is from 15 seconds to 2 minutes, and preferably from 25 seconds to 1 minute and 40 seconds for a light-sensitive material for photographing and from 8 seconds to 80 seconds and preferably from 10 seconds to 45 seconds for a photographic light-sensitive material for print.

The desilvering step in this invention is carried by the combinations of a bleaching step, a fixing step, and a blixing step, and typical examples of these combinations are as follows.

(1) Bleaching-fixing
(2) Bleaching-blixing
(3) Bleaching-blixing-fixing
(4) Bleaching-washing-fixing
(5) Blixing
(6) Fixing-blixing In a light-sensitive material for photographing, the combination (1), (2), (3), or (4) is preferable, and the combination (1), (2) or (3) is more preferable. In a photographic light-sensitive material for print, the combination (5) is preferable.

The present invention can be applied to a desilvering processing through, for example, a stop bath, a wash bath, etc., after color development processing.

In the desilvering processing step in the present invention, such as bleaching, blixing, fixing, etc., it is preferable that the processing solution is stirred as strong as possible for more efficiently obtaining the effect of the present invention.

As a practical method of strengthening the stirring, there are a method of applying jet stream of the processing solution to the surface of the emulsion layer of a photographic light-sensitive material, described in JP-A-62-183460 and JP-A-62-183461, a method of increasing the stirring effect by using a rotation means, described in JP-A-62-183461, a method of improving the stirring effect by transferring a photographic light-sensitive material while contacting the surface of the emulsion layer thereof with a wiper blade disposed in the processing solution to form a disturbed stream on the surface of the emulsion layer of the light-sensitive material, and a method of increasing the circulating amount of the entire processing solution. The foregoing stirring increasing means is preferably used for a color developer, a wash solution, or a stabilization solution.

It is preferable that the processing process of the present invention is carried out using an automatic processor. The transporting method of photographic light-sensitive materials in such an automatic processor is described in JP-A-60-191257, JP-A-60-191258, and JP-A-60-191259. Also, for carrying out quick processing in an automatic processor, it is preferable to shorten the crossover between the processing baths. The automatic processor wherein the crossover time is 5 seconds or shorter is described in JP-A-1-319038.

In the case of carrying out continuous processing using an automatic processor according to the processing process of the present invention, it is preferred to supply each replenisher to each processing solution in accordance with the amount of photographic light-sensitive materials processed for compensating the loss of the components of each processing solution with the processing of the photographic light-sensitive materials, and also for preventing the accumulation of undesirable components dissolved out from the photographic light-sensitive materials processed in each processing solution. Also, two or more processing tanks may be employed for each processing step and in this case, it is preferred to employ a countercurrent system of supplying the replenisher from the post-bath tank to the preceding bath tank. In particular, in a washing step and a stabilization step, a cascade-type countercurrent system of from 2 to 4 stages is preferably used.

The amount of each replenisher is preferably low if the change of the composition in the processing solution does not cause troubles for the photographic performance and staining of the solution.

The amount of the replenisher for a color developer is from 100 ml to 3,000 ml, and preferably from 100 ml to 2,200 l per square meter of a photographic light-sensitive material being processed in the case of a color photographic material and is from 20 ml to 500 ml, and preferably from 30 ml to 350 ml per square meter of a photographic light-sensitive material in the case of a color print material.

The amount of the replenisher for a bleaching solution is from 10 ml to 1,000 ml, and preferably from 50 ml to 550 ml per square meter of a photographic light-sensitive material being processed in the case of a color photographic material and is from 20 ml to 500 ml, and preferably from 50 ml to 300 ml per square meter of a photographic light-sensitive material in the case of a print material.

The amount of the replenisher for a blix solution is from 200 ml to 3,000 ml, and preferably from 250 ml to 1,300 ml per square meter of a photographic light-sensitive material in the case of a color photographic material and is from 20 ml to 300 ml, and preferably from 50 ml to 200 ml per square meter of a photographic light-sensitive material in the case of a print material.

The replenisher for a blix solution may be replenished as one solution or may be replenished separately as a bleaching composition and a fixing composition. Also, a mixture of the overflow solutions from bleaching baths and/or fixing baths may be used as a replenisher for a blix solution.

The amount of the replenisher for the fixing solution is from 300 ml to 3,000 ml, and preferably from 300 ml to 1,200 ml per square meter of a photographic light-sensitive material in the case of a color photographic material and is from 20 ml to 300 ml, and preferably from 50 ml to 200 ml per square meter of a photographic light-sensitive material in the case of a print material.

The amount of the replenisher for wash water or a stabilization solution is from 1 to 50 times, preferably from 2 to 30 times, and more preferably from 2 to 15 times the amount of the solution carried from the preceding bath per unit area of a photographic light-sensitive material.

For further lowering the amount of the foregoing replenisher for environmental preservation, it is preferable to use a combination of various regeneration methods. The regeneration of each processing solution may be practiced while circulating the processing solution in an automatic processor or after once recovering the processing solution from the processing tank and applying thereto a proper regeneration treatment, the solution may be supplied again to the processing bath as the replenisher.

Since a metal chelate bleaching agent in a bleaching solution and/or a blix solution becomes in a reduced state with bleaching processing, it is preferred to employ a continuous regeneration method for the bleaching solution and/or the blix solution in corporation with processing. Practically, it is preferred to blow air into the bleaching solution and/or the blix solution by means of an air pump and reoxidizing (or so-called aerating) the metal chelate in a reduced state with oxygen. Furthermore, by adding an oxidizing agent, such as hydrogen peroxide, a persulfate, a bromate, etc., to the bleaching solution and/or the blix solution, the processing solution can be also regenerated.

The regeneration of a fixing solution and a blix solution is carried out by electrolytically reducing accumulated silver ions. Furthermore, it is preferred for keeping the fixing ability to remove accumulating halogen ions with an anion exchange resin.

For reducing the using amount of wash water, an ion exchange or an ultrafiltration is used, and the use of an ultrafiltration is particularly preferred.

The color developer being used in this invention contains a conventionally known aromatic primary amine color developing agent. Preferred color developing agents are p-phenylenediamine derivatives and specific examples thereof are 4-amino-N-ethyl-N-(β-hydroxyethyl)-3-methylaniline, 4-amino-N-ethyl-N-(β-hydroxypropyl)-3-methylaniline, 4-amino-N-ethyl-N-(4-hydroxybutyl)-3-methylaniline, 4-amino-N-ethyl-N-(β-methanesulfonamidoethyl)-3-methylaniline, 4-amino-N-(3-carbamoylpropyl)-N-n-propyl-3-methylaniline, and 4-amino-N-ethyl-N-(β-hydroxyethyl)-3-methoxyaniline.

Also, the salts of these p-phenylenediamine derivatives and sulfates, hydrochlorides, sulfites, naphthalenedisulfonic acid, or p-toluenesulfonic acid may be used as the color developing agent.

The amount of the aromatic primary amine developing agent used is preferably from 0.0002 mol to 0.2 mol, and more preferably from 0.001 mol to 0.1 mol per liter of the developer.

Also, the color developer can contain, if necessary, a sulfite, such as sodium sulfite, potassium sulfite, sodium bisulfite, potassium bisulfite, sodium metasulfite, potassium metasulfite, etc., or a carbonylsulfite addition product as the preservative.

Also, as compounds directly preserving the foregoing aromatic primary amine color developing agent, various hydroxylamines, such as the compounds shown by JP-A-63-5341 and JP-A-63-106655, are preferred and of these compounds, the compounds having a sulfo group or a carboxy group are particularly preferred. Furthermore, the hydroxamic acids described in JP-A-63-43138, the hydrazines and hydrazides described in JP-A-63-146041, the phenols described in JP-A-63-44657 and JP-A-63-58443, the α-hydroxyketones and the α-aminoketones described in JP-A-63-44656 and/or various kinds of saccharides described in JP-A-63-36244 can be preferably added to the color developer.

Also, the monoamines described in JP-A-63-4235, JP-A-63-24254, JP-A-63-21647, JP-A-63-146040, JP-A-63-27841, and JP-A-63-25654; the diamines described in JP-A-63-30845, JP-A-63-14640, and JP-A-63-43139; the polyamines described in JP-A-63-21647, JP-A-63-26655, and JP-A-63-44655; the nitfoxy radicals described in JP-A-63-53551, the alcohols described in JP-A-63-43140 and JP-A-63-53549, the oximes described in JP-A-63-56654, and the tertiary amines described in JP-A-63-239447 are preferably used together with the aforesaid compounds.

The color developer may contain the various metals described in JP-A-57-44148 and JP-A-57-53749, the salicylic acids described in JP-A-59-180588, the alkanolamines described in JP-A-54-3582, the polyethyleneimines described in JP-A-56-94349, or the aromatic polyhydroxy compounds described in U.S. Pat. No. 3,746,544 as other preservatives. The addition of the aromatic polyhydroxy compounds is particularly preferable.

The addition amount of the foregoing preservative is from 0.005 mol to 0.2 mol, and preferably from 0.01 mol to 0.05 mol per liter of the color developer.

The pH of the color developer being used in this invention is in the range of from 9.0 to 12.0, and preferably from 9.5 to 11.5.

The color developer for use in this invention can further contain compounds conventionally known as components for color developers.

That is, for keeping the foregoing pH of the color developer, it is preferred to use various buffers. Specific examples of the buffer are sodium carbonate, potassium carbonate, sodium bicarbonate, potassium bicarbonate, tri-sodium phosphate, tri-potassium phosphate, di-sodium phosphate, di-potassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the invention is not limited to these compounds.

The addition amount of the buffer to the color developer is preferably not less than 0.1 mol/liter, and particularly preferably from 0.1 to 0.4 mol/liter.

Moreover, the color developer can further contain the compounds shown by formula (I) for use in this invention and other various chelating agents as precipitation inhibitors for calcium and magnesium or for improving the stability of the color developer.

As the foregoing chelating agents, organic acid compounds are preferable and, for example, there are aminopolycarboxylic acids, organic phosphonic acids, and phosphonocarboxylic acids. Specific examples thereof are nitrilotriacetic acid, diethylenetriaminepentaacetic acid, ethylenediaminetetraacetic acid, N,N,N-trimethylenephosphonic acid, ethylenediamine-N,N,N',N'-teramethylenephosphonic acid, transcyclohexanediaminetetraacetic acid, 1,2-diaminopropanetetraacetic acid, hydroxyethyliminodiacetic acid, glycol ether diaminetetraacetic acid, ethylenediamine o-hydroxyphenylacetic acid, 2-phosphonobutane-1,2,4-tricarboxylic acid, 1-hydroxyethylidene- 1,1-diphosphonic acid, and N,N'-bis(2-hydroxy benzyl-)ethylenediamine-N,N'-diacetic acid.

These chelating agents may be used, if desired, as a mixture of two or more kinds thereof.

The addition amount of the chelating agent may be one sufficient for blocking metal ions in the color developer and, for example, from 0.001 mol to 0.05 mol, and preferably from 0.003 mol to 0.02 mol per liter of the color developer.

The color developer can further contain, if desired, a development accelerator. Examples of the development accelerator are the thioether compounds described in JP-B-37-16088, JP-B-37-5987, JP-B-38-7826, JP-B-44-12380, JP-B-45-9019, U.S. Pat. No. 3,818,247, etc.; the p-phenylenediamine compounds described in JP-A-52-49829 and JP-A-50-15554; the quaternary ammonium salts described in JP-A-50-137726, JP-B-44-30074, JP-A-56-156826, JP-A-52-43429, etc.; the amine compounds described in U.S. Pat. Nos. 2,494,903, 3,128,182, 4,230,796, 3,253,919, 2,482,546, 2,596,926, and 3,582,346, JP-B-41-11431, etc.; the polyalkylene oxides described in JP-B-37-16088, JP-B-42-25201, JP-B-41-11431, U.S. Pat. Nos. 3,128,183 and 3,532,501, and imidazoles such as 2-methylimidazole, imidazole, etc.

Also, the 1-phenyl-3-pyrazolidones described JP-A-56-64339, JP-A-57-144547, and JP-A-58-115438 are preferably added to the color developer as auxiliary developing agents for quickening the color development.

The color developer for use in this invention can contain, if desired, an optional antifoggant. As the antifoggant, alkali metal halides, such as sodium chloride, potassium bromide, potassium iodide, etc., and organic antifoggants can be used. Examples of the organic antifoggant are nitrogen-containing heterocyclic compounds, such as benzotriazole, 6-nitrobenzimidazole, 5-nitrosioindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine.

The color developer being used in this invention may contain an optical whitening agent. As the optical whitening agent, 4,4'-diamino-2,2'-disulfostilbene compounds are preferably used. The addition amount thereof is from 0 to 5 g/liter, and preferably from 0.1 g/liter to 4 g/liter.

Also, if desired, various surface active agents such as alkylsulfonic acids, arylsulfonic acids, aliphatic carboxylic acids, aromatic carboxylic acids, etc., may be added to the color developer.

The processing temperature for the color developer being used in this invention is preferably from 20° C. to 55° C., and preferably more from 30° C. to 55° C. The processing time preferably is from 20 seconds to 5 minutes, more preferably from 30 seconds to 3 minutes and 20 seconds, and particularly preferably from 1 minute to 2 minutes and 30 seconds for a color photographic material for photographing, and preferably from 10 seconds to 1 minute and 20 seconds, more preferably from 10 seconds to 60 seconds, and particularly preferably from 10 seconds to 40 seconds for a print material.

The processing process of the present invention can be applied to color reversal processing.

The black and white developer being used in processing color reversal is an ordinary known black and white primary developer which is used for reversal processing for a color photographic light-sensitive material. The black and white primary developer can contain various additives well known as the additives for a black and white developer being used for developing a black and white silver halide photographic material.

As typical additives, there are developing agents, such as 1-phenyl-3-pyrazolidone, Metol, and hydroquinone; preservatives such as sulfites, etc.; accelerators, such as sodium hydroxide, sodium carbonate, potassium carbonate, etc.; inorganic or organic inhibitors, such as potassium bromide, 2-methylbenzimidazole, methylbenzothiazole, etc.; water softeners, such as polyphosphates, etc.; and development inhibitors, such as a slight amount of an iodide and mercapto compounds.

By adding the compound shown by formula (I) for use in this invention to wash water or a stabilization solution, the effect of the present invention is efficiently obtained.

Wash water being used for a wash step and/or the stabilization solution can contain various surface active agents for preventing the occurrence of water spots when drying the photographic light-sensitive material after processing.

As such surface active agents, there are polyethylene glycol type nonionic surface active agents, polyhydric alcohol type nonionic surface active agents, alkylbenzenesulfonate type anionic surface active agents, higher alcohol sulfuric acid ester salt type anionic surface active agents, alkylnaphthalenesulfonate type anionic surface active agents, quaternary ammonium salt type cationic surface active agents, amine salt type cationic surface active agents, amino acid type amphoteric surface active agents, and betaine type amphoteric surface active agents.

However, since in the case of using an ionic surface active agent, it sometimes happens that the surface active agent reacts with various ions entering the processing solution with processing to form insoluble matters, nonionic surface active agents are preferably used, and in particular, alkylphenol-ethytene oxide addition products are preferably used. In this case, as the alkylphenol, octyl, nonyl, dodecyl, and dinonylphenol are preferred, and the addition mol number of the ethylene oxide is particularly preferably from 8 to 14 mols. Furthermore, silicone surface active agents having a high defoaming effect are preferably used.

Also, wash water and/or the stabilization solution can contain various antibacterial agents or antifungal agents for preventing the formation of furs, and the generation of fungi in the photographic light-sensitive materials after processing.

Examples of these antibacterial agents and antifungal agents are the thiazolylbenzimidazole compounds as described in JP-A-57-157244 and JP-A-58-105145; the isothiazolone compounds as described in JP-A-54-27424 and JP-A-57-8542; chlorophenol compounds, such as trichlorophenol, etc.; bromophenol compounds; organotin compounds and organozinc compounds; thiocyanic acid or isothiocyanic acid compounds; acid amide compounds; diazine and triazine compounds, thiourea compounds; benzotriazole alkylguanizine compounds; quaternary ammonium salts, such a benzammonium chloride, etc.; antibiotics, such as penicillin, etc.; and the ordinary antibacterial agents described in *Journal of Antibacterial and Antifungus Agents*, Vol. 1, No. 5, 207–223(1983).

Also, various germicides described in JP-A-48-83820 can be used.

Also, wash water and/or the stabilization solution can further contain various chelating agents in the range of not reducing the effect of the compound shown by formula (I) for use in this invention.

As preferred chelating agents, there are aminopolycarboxylic acids, such as ethylenediaminetetraacetic acid, diethylenetriaminepentaacetic acid, etc.; organic phosphonic acids, such as 1-hydroxyethylidene-1,1-diphosphonic acid, ethylenediamine-N,N,N',N'-tetramethylenephosphonic acid, etc.; and the hydrolyzed products of maleic anhydride polymers described in European Patent 345172A1.

Furthermore, it is preferred that the foregoing preservative which can be incorporated in the fixing solution and the blix solution is incorporated in wash water.

As the stabilization solution being used for the stabilization step, a processing solution for stabilizing dye images is used. For example, there are an organic acid or a solution having a buffering ability of a pH of from 3 to 6 and a solution containing an aldehyde (e.g., formalin and glutaraldehyde), hexahydrotriazine, hexamethylenetetramine, or an N-methylol compound (e.g., dimethylolurea, N-methylolpyrazole, and N-methylol-1,2,4-triazole) as an image stabilizer.

If desired, the stabilization solution can further contain a saturated cyclic amine (e.g., morpholine and piperazine), an ammonium compound, such as ammonium chloride, ammonium sulfite, etc., a metal compound, such as a Bi compound, an Al compound, etc., an optical brightening agent, a hardening agent, and the alkanolamine described in U.S. Pat. No. 4,786,583.

Also, for the wash step and the stabilization step, a multistage countercurrent system is preferably employed and the stage number is preferably from 2 to 4 stages.

The amount of the replenisher for the processing solution of from 1 to 50 times, preferably from 2 to 30 times, and more preferably from 2 to 15 times the amount of the processing solution carried by the photographic light-sensitive material from the preceding bath per unit area of the light-sensitive material.

As water for the wash step or the stabilization step, city water may be used but water which is subjected to a deionizing treatment with ion exchange resins to lower the concentrations of calcium and magnesium to 5 mg/liter or lower and water sterilized with a halogen, ultraviolet sterilizing lamp are preferably used.

Also, as water for supplying the evaporation loss of water, city water may be used, but foregoing deionized water or sterilized water, which is preferably used for the foregoing wash step or stabilization step is preferably used.

In the present invention, it is preferred to supply a proper amount of water, a correcting solution, or a replenisher for a processing solution for correcting the concentration of not only the bleaching solution and blix solution but also other processing solutions by evaporation.

By employing a method of .introducing the overflow solution from the wash step or the stabilization step into a bath having a fixing ability, which is the preceding bath, the amount of waste liquids can be reduced.

As photographic light-sensitive materials which can be processed by the processing composition of the present invention, there are ordinary black and white silver halide photographic materials (e.g., black and white light-sensitive materials for photographing, X-ray black and white light-sensitive materials, and black and white light-sensitive materials for printing), ordinary multi layer silver halide color photographic materials (e.g., color negative photographic films, color reversal photographic films, color positive photographic films, cine color negative photographic films, color photographic papers, reversal color photographic papers, and direct positive color photographic papers), infrared photographic light-sensitive materials for laser scanner, diffusion transfer photographic light-sensitive materials (e.g., silver diffusion transfer photographic light-sensitive materials, and color diffusion transfer photographic light-sensitive materials), etc.

The photographic light-sensitive material being processed by the processing composition of the present invention can have various layer structures (e.g., silver halide emulsion layers each having a light-sensitive to red, green, or blue, a subbing layer, an antihalation layer, a filter layer, interlayers, and surface protective layer(s)) and layer dispositions on one surface or both the surfaces thereof according to the purpose of the photographic light-sensitive materials.

In the present invention, there are no particular restrictions on the supports of the photographic light-sensitive materials the coating methods, the kinds of silver halide being used for the silver halide emulsion layers, surface protective layers , etc. (e.g. , silver iodobromide, silver iodochlorobromide, silver bromide, silver chlorobromide, and silver chloride); the grain forms of the silver halide grains (e.g., cubic, tabular, and spherical); the grain sizes thereof; the variation coefficients thereof; the crystal structures (e.g., core/shell structure, multiphase structure, and uniform phase structure); the production method thereof (e.g., a single jet method and a double jet method); binders (e.g., geratin); hardening agents; antifoggants; metal doping agents; silver halide solvents; thickeners; emulsion precipitating agents; dimensional stabilizers; adhesion inhibitors; stabilizers; color mixing inhibitors; stain inhibitors; dye image stabilizers, chemical sensitizers; spectral sensitizers; sensitivity increasing agents; super sensitizers; nucleating agents; couplers (e.g., pivaloylacetanilide type or benzoyl-acetanilide type yellow couplers, 5-pyrazolone type or pyrazoloazole type magenta couplers, phenol type or naphthol type cyan couplers, DIR couplers, bleach accelerator releasing type couplers, competing couplers, and colored couplers); coupler dispersing methods (e.g., oil drop-in-water dispersion method using a high-boiling solvent); plasticizers; antistatic agents; lubricants; coating aids; surface active agents; brightening agents; formalin scavengers; light scattering agents; matting agents; light absorbents; ultraviolet absorbents; filter dyes, irradiation dyes; development improving agents; delustering agents; antiseptics (e.g., 2-phenoxyethanol); antifungus agents, etc., and those described in *Product Licensing*, Vol. 92, 107 to 110 (December, 1971), *Research Disclosure* (RD), No. 17643 (December, 1978), ibid., No. 18716 (November, 1979), and ibid., No. 307105 (November, 1989) can be used.

The present invention can be applied to any kinds of color photographic materials but for achieving the objects of the present invention, the dry thickness of the entire constituting layers, excluding the support of the color photographic material for photographing, the subbing layer and the back layer, is preferably not thicker than 20.0 μm, and more preferably not thicker than 18.0 μm in the case of the color photographic material for photographing and is not thicker than 16.0 μm, and more preferably not thicker than 13.0 μm in the case of a print material.

If the layer thickness is outside the foregoing preferred range, the bleach fog caused by the color developing agent remaining after color development and stains after processing are liable to increase. The occurrence of the bleach fog and stains is caused by a green-sensitive emulsion layer, and as the result thereof, the increase of magenta color becomes larger than the increases of cyan color and yellow color.

In addition, the lower limit in the foregoing range of the layer thickness is preferably as thin as possible in the range of not greatly reducing the performance of the color photographic material. The lower limit of the total dry layer thickness of the entire constituting layers, excluding the support of the color photographic material, the subbing layer, and the back layer, is 12.0 μm in the case of a color photographic material and is 7.0 μm in the case of a print material .

In the case of a photographic material for photographing, a layer is usually disposed between the lowermost light-sensitive emulsion layer and the subbing layer on the support and the lower limit of the total dry thickness of the layer (the layer may be plural) is 1.0 μm. Also, the reduction of the layer thickness may be practiced for light-sensitive emulsion layers and/or the light-insensitive layers.

The layer thickness of a multilayer color photographic material is measured by the following method.

That is, the color photographic material being measured is stored for 7 days after the preparation thereof under the condition of 25° C. and 50% RH. First, the total thickness of the color photographic material is measured, then, after removing the coated layers on the support, the thickness thereof is measured again, and the difference between the former thickness and the latter thickness is defined as the layer thickness of the entire coated layers of the color photographic material excluding the support. The thickness can be measured by using, for example, a film thickness measuring apparatus by a contact-type piezoelectric conversion element (K-402B Stand., trade name, manufactured by Anritsu electric Co., Ltd.). In addition, the coated layers on the support can be removed using an aqueous solution of sodium hypochloride.

Next, the cross section of the foregoing color photographic material is photographed using a scanning type electron microscope (the magnification is preferably at least 3,000 magnifications) to measure actually the thickness of the entire layers on the support and the thickness of each layer, and by comparing the measured results with the measured value (the absolute value of the actually measured thickness) of the total thickness by the foregoing film thickness measuring apparatus, the thickness of each layer can be calculated.

The swelling ratio [$(A-B)/B\times 100$; A: the equilibrium swelled layer thickness in water at 25° C.; B: the dry total layer thickness at 25° C., 55% RH] in the color photographic material being processed by the process of this invention is preferably from 50 to 200%, and more preferably from 70 to 150%.

If the swelling ratio is outside the foregoing range, the remaining amount of a color developing agent is increased and also the photographic performance, the image quality, such as the desilvering property, etc., and the film properties, such as the film strength, etc., are deteriorated.

Furthermore, the swelling speed of the color photographic material being processed by the process of the present invention is as follows. That is, when 90% of the maximum swelled layer thickness of the color photographic material in a color developer (30° C., 3 minutes and 15 seconds) is defined as a saturated swelled layer thickness and the time required for reaching ½ of the saturated swelled layer thickness is defined as swelling speed $T_{\frac{1}{2}}$, $T_{\frac{1}{2}}$ is preferably 15 seconds or lower, and more preferably 9 seconds or lower.

The silver halide contained in the silver halide photographic emulsion layers of the color photographic material being processing by the process of this invention may have any silver halide composition. For example, there are silver chloride, silver bromide, silver chlorobromide, silver iodobromide, silver iodochloride, and silver iodochlorobromide.

In the case of color photographic materials for photographing and color reversal photographic materials (e.g., color negative photographic films, color reversal photographic films, and color reversal photographic papers), silver iodobromide, silver iodochloride or silver iodochlorobromide each containing from 0.1 mol % to 30 mol % silver iodide is preferred. In particular, silver iodobromide containing 1 mol % to 25 mol % silver iodide is preferred.

In the case of a direct color photographic material, silver bromide or silver chlorobromide is preferred and also silver chloride is preferred for carrying out quick processing. In the case of a color photographic paper, silver chloride or silver chlorobromide is preferred and in particular, silver chlorobromide having a silver chloride content of at least 80 mol %, more preferably at least 95%, and most preferably at least 98 mol % is preferred.

The known photographic additives which can be use in this invention are described in the following three Research Disclosures (RD) and the related portions are shown in the following table.

| Kind of additive | RD 17643 (Dec. 1978) | RD 18716 (Nov. 1979) | RD 307105 (Nov. 1989) |
|---|---|---|---|
| 1. Chemical sensitizer | p. 23 | p. 648 right column (RC) | p. 866 |
| 2. Sensitivity increasing agent | — | p. 648 right column (RC) | — |
| 3. Spectral sensitizer and super sensitizer | pp. 23–24 | p. 648 RC–p. 649 RC | pp. 866–868 |
| 4. Whitening agent | p. 24 | p. 647 RC | p. 868 |
| 5. Anti-foggant and stabilizer | pp. 24–25 | p. 649 RC | pp. 868–870 |
| 6. Light absorbent, filter dye, and ultra-violet absorbent | pp. 25–26 | p. 649 RC–p. 650 (left column (LC) | p. 873 |
| 7. Anti-stain agent | p. 25 RC | p. 650 LC–RC | p. 872 |
| 8. Dye image stabilizer | p. 25 | p. 650 LC | p. 872 |
| 9. Hardener | p. 26 | p. 651 LC | pp. 874–875 |
| 10. Binder | p. 26 | p. 651 LC | pp. 873–874 |
| 11. Plasticizer and lubricant | p. 27 | p. 650 RC | p. 876 |
| 12. Coating aid and surfactant | pp. 26–27 | p. 650 RC | pp. 875–876 |
| 13. Anti-static agent | p. 27 | p. 650 RC | pp. 876–877 |
| 14. Matting agent | — | — | pp. 878–879 |

For the color photographic light-sensitive materials being processed by the process of this invention, various color couplers can be used and practical examples there are described in the patents described in foregoing *Research Disclosure*, No. 17643, VII-C to G and ibid., No.

307105, VII-C to G and also JP-A-62-215272, JP-A-3-33847, JP-A-2-33144, etc.

Suitable supports which can be used for the color photographic materials being processed by the process of this invention are also described, e.g., in foregoing *Research Disclosure*, No. 17643, page 28 and ibid., No. 18716 from page 647, right column to page 648, left column.

The present invention can be applied to various kinds of color photographic light-sensitive materials. Typical examples thereof are general or cine color negative photographic films, color reversal photographic films for slide or television, color photographic papers, direct positive color photographic papers, color positive photographic films, and color reversal photographic papers.

The color reversal film may be of a type of containing couplers in the color photographic material (coupler-in-emulsion type)or of a type of containing couplers in the developers (coupler-in-developer type).

Nest, the following examples are intended to illustrate the present invention practically but not limit it in any way.

| | |
|---|---|
| (Color Developer) | |
| Diethylenetriaminepentaacetic Acid | 1.0 g |
| Chelate compound (shown in Table 1) | 0.01 mol |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-(N-Ethyl-N-β-hydroxyethylamino)-2-methylaniline Sulfate | 4.5 g |
| Water to make | 1000 ml |
| pH | 10.05 |
| (Bleaching Solution) | |
| Iron(III) Ammonium 1,3-Propanediaminetetraacetate | 0.55 mol |
| Ammonium Bromide | 85 g |
| Ammonium Nitrate | 20 g |
| Glycolic Acid | 55 g |
| Water to make | 1000 ml |
| pH | 4.0 |
| (Fixing Solution) | |
| Ethylenediaminetetraacetic Acid Secondary Ammonium Salt | 1.7 g |
| Ammonium Sulfite | 14.0 g |
| Aqueous Ammonium Thiosulfate Solution (700 g/liter) | 260.0 ml |
| Water to make | 1000 ml |
| pH | 7.0 |

Wash Water

City water was passed through a mixed bed type column filled with an H-type strong acidic cation exchange resin (Amberlite IR-120B, trade name, made by Rohm and Haas Company) and an OH-type strong basic anion exchange resin (Amberlite IRA-400) to lower the concentration of calcium and magnesium below 3 mg/liter, and then 20 mg/liter of sodium dichloroisocyanurate and 150 mg/liter of sodium sulfate were added to the water. The pH of the solution was in the range of from 6.5 to 7.5.

| (Stabilization Solution) | |
|---|---|
| Formalin (37%) | 1.2 ml |
| Surface Active Agent $[C_{10}H_{21}—O(CH_2CH_2O)_{10}—H]$ | 0.4 g |
| Ethylene Glycol | 1.0 g |
| Water to make | 1000 ml |

-continued

| (Stabilization Solution) | |
|---|---|
| pH | 5.0 to 7.0 |

To each of the color developer described above were added ferric chloride at 5 ppm as a ferric ion and calcium nitrate at 150 ppm as a calcium ion to provide samples 101 to 107.

In a hard polyvinyl chloride container of 10 cm in length, 25 cm in width, and 30 cm in depth was filled 5 liters of each sample, and then each sample was subjected to a test with the passage time for 30 days at 38° C. while continuously circulating the solution in the container at a rate of 3 liters/minute by means of a pump.

In addition, a floating lid covering 200 $cm^2$ of the surface of the solution was placed in the container and the surface area of the solution exposed to air was 50 $cm^2$.

Then, the multilayer color photographic material sample 105 described in Example 1 of JP-A-2-89045 was sliced in a width of 35 mm and wedge-exposed of 5 CMS at a color temperature of 4800° K. The color photographic material was processed by the following processing steps using each of Samples 101 to 107 directly after preparation (new solution) and after the test with the passage of time as the color developer.

| Step | Processing Time | Processing Temperature (°C.) |
|---|---|---|
| Color Development | 3 min. and 15 sec. | 37.8 |
| Bleach | 50 sec. | 38.0 |
| Fix | 100 sec. | 38.0 |
| Wash (1) | 30 sec. | 38.0 |
| Wash (2) | 20 sec. | 38.0 |
| Stabilization | 20 sec. | 38.0 |

The B (blue) density obtained using the solution after the test with the passage of time at the exposure amount at which the B density measured by blue light (B light) in the case of processing with the new solution was measured with an X Light 310 Type photographic densitometer and the difference $\Delta D_B$ from the case of using the new solution was determined.

Also, the residual ratios of the developing agent and hydroxylamine in the color developer after 30 days were obtained by analysis. Furthermore, for each color developer after 30 days, the presence of precipitates was visually determined.

The results are shown in Table 1.

TABLE 1

| No. | Chelating Agent | $\Delta D_B$ | (A) (%) | (B) (%) | Precipitates* |
|---|---|---|---|---|---|
| 101 | Ethylenediamine-tetraacetic Acid | −0.4 | 62 | 31 | G |
| 102 | Ethylenediamino-tetramethylene-phosphonic Acid | −0.05 | 88 | 72 | B |
| 103 | Compound 1 | −0.09 | 85 | 69 | G |
| 104 | Compound 3 | −0.05 | 91 | 75 | G |
| 105 | Compound 4 | −0.06 | 90 | 73 | G |
| 106 | Compound 20 | −0.08 | 87 | 70 | G |

TABLE 1-continued

| No. | Chelating Agent | $\Delta D_B$ | (A) (%) | (B) (%) | Precipitates* |
|---|---|---|---|---|---|
| 107 | Compound 33 | −0.05 | 89 | 73 | G |

(A): Residual ratio of color developing agent
(B): Residual ratio of hydroxylamine which was determined by a spectrophotometric method by adding, after oxidizing with iodine, sulfonic acid and α-naphthylamine thereto, to generate red color.
(*): G: No precipitations
B: Precipitates formed. (The larger the number of B is, the more the precipitation is severe.)

As is clear from the results shown in Table 1, it can be seen that when the conventional chelating agents are added, the prevention of the formation of precipitates and the maintenance of the stability of the color developer are insufficient, while by adding the compounds of formula (I) for use in this invention, the excellent effects are obtained.

EXAMPLE 2

To the fixing solution used in Example 1 was added 3 g/liter of each of Compounds 1, 3, 4, and 20 of formula (I) in this invention and further 100 ml/liter of the bleaching solution described in Example 1 was added to the fixing solution to provide Samples 201 to 204. Also, for the sake of comparison, the fix solution of Example I without having added the compound of formula (I) but added with the bleaching solution only was prepared to provide Sample 205.

In addition, the addition amount of the bleaching solution corresponds to the general amount of bleaching solution attached to the color photographic material processed and carried into a fixing solution and accumulated to equilibrium.

Then, 5 liters of each sample were tested for 30 days by the same test method as in Example 1, and the measurement of the residual ratio of ammonium sulfite and the observation of the state of each sample solution were carried out.

The results obtained are shown in Table 2 below.

TABLE 2

| No. | Compound of Formula (I) | Residual Ratio of Ammonium Sulfite (%) | State of the solution |
|---|---|---|---|
| 201 | Compound 1 | 68 | Not turbid |
| 202 | Compound 3 | 65 | " |
| 203 | Compound 4 | 66 | " |
| 204 | Compound 20 | 60 | " |
| 205 | none | 8 | Sulfur eposited to form turbidity. |

As is shown in the above Table 2, it can be clearly seen that by adding the compounds of formula (I) in this invention, the oxidation of ammonium sulfite in the fixing solution is restrained, whereby no turbidity occurs in the fixing solution and the stability is greatly improved.

EXAMPLE 3

The stabilization solution as in Example 1 was used as Comparison Sample 301 and by adding 100 mg/liter of each of Compounds 1, 3 and 4 of formula (I) to the stabilization solution Samples 302 to 303 were provided.

The multilayer color photographic material as in Example 1 was processed by the same manner as in Example 1 using each of the stabilization solutions and the fresh solutions of the color developer (Sample 101) and others in Example 1.

After processing, the multilayer color photographic material was stored for one week under the wet and heat conditions of 80° C. and 70% RH. Then, the stain increase (ΔDmin) of magenta before and after processing was determined.

The results obtained are shown in Table 3.

TABLE 3

| No. | Chelate Compound | ΔDmin | |
|---|---|---|---|
| 301 | none | 0.25 | Comparison |
| 302 | Compound 1 | 0.10 | Invention |
| 303 | Compound 3 | 0.07 | Invention |
| 304 | Compound 4 | 0.11 | Invention |

From the results shown in above Table 3, it can be seen that by using the stabilizing solutions added with the compounds shown by formula (I) according to this invention, the increase of stains is restrained and the storage stability of the color images is improved.

EXAMPLE 4

A bleaching solution having the following composition was prepared.

| | |
|---|---|
| Hydrogen Peroxide (30%) | 50 ml |
| Potassium Bromide | 28 g |
| Potassium Hydrogenphosphate | 10 g |
| Water to make | 1 liter |
| pH | 3.5 |

This bleaching solution was used as Comparison Sample 401 and by adding 100 g/liter of each of the Comparison compound and Compounds 1, 3, and 4 of formula (I) to the bleaching solution, Samples 402 to 405 were prepared.

For determining the bleaching ability of each sample, the multilayer color photographic material as in Example 1 was processed using Sample 101 in Example 1 as the color developer and the fixing solution, the stabilization solution, and wash water as in Example 1.

In regard to Samples 401 to 405, each solution directly after preparation (fresh solution) or each solution after storing 3 days at 40° C. was used.

After processing, the amount of residual silver at the maximum density portion was determined by a fluorescent X-ray analysis and at the same time, the residual amount of hydrogen peroxide was analyzed.

Processing Steps

| Step | Processing Time | Processing Temp. (°C.) |
|---|---|---|
| Color Development | 3 min. 15 sec. | 38 |
| Bleach | 5 min. | 40 |
| Fix | 100 sec. | 38 |
| Wash (1) | 30 sec. | 38 |
| Wash (2) | 20 sec. | 38 |
| Stabilization | 20 sec. | 38 |

The results obtained are shown in Table 4.

TABLE 4

| No. | Chelating Compound | Residual Amount of Silver (μg/cm²) Fresh Soln. | Passed | Residual Ratio* of $H_2O_2$ (%) |
|---|---|---|---|---|
| 401 | none | 2 | 30 | 42 |
| 402 | Ethylenediamine- | 3 | 16 | 61 |

TABLE 4-continued

| No. | Chelating Compound | Residual Amount of Silver ($\mu g/cm^2$) Fresh Soln. | Passed | Residual Ratio* of $H_2O_2$ (%) |
|---|---|---|---|---|
| | tetraacetic Acid | | | |
| 403 | Compound 1 | 4 | 10 | 75 |
| 404 | Compound 3 | 3 | 6 | 83 |
| 405 | Compound 4 | 4 | 9 | 77 |

(*): By titration of potassium permanganate solution under a sulfuric acid condition.

As shown in the above Table 4, it can be seen that even in the case of the bleaching solution using hydrogen peroxide as the oxidizing agent, the stability of the bleaching solution is improved by using the compound shown by formula (I) of the present invention.

EXAMPLE 5

In Sample No. 214 (multilayer color photographic paper) described in Example 2 of JP-A-2-139544 (corresponding to U.S. Pat. No. 5,122,444), III-10 was used in place of III-23 described in the above patent application as the bisphenol compound, the yellow coupler (ExY), the cyan coupler (ExC), the dye image stabilizer (Cpd-8), the solvent (Solv-6), and the oxonol dyes were changed with the following compounds, and also the following antiseptics (antibacterial and antifungal agent) was further used to provide multilayer color photographic paper B.

(ExY) Yellow Coupler

A 1:1 (mol ratio) mixture of:

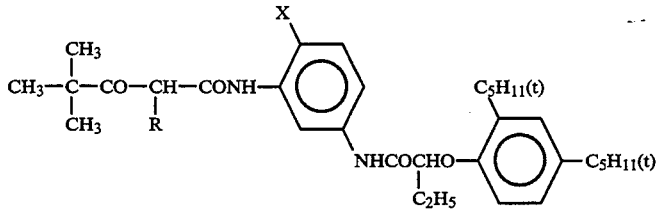

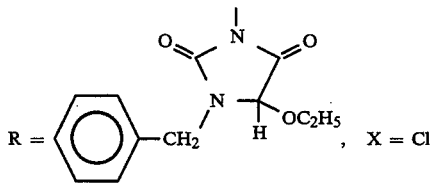

and

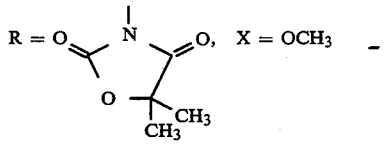

(ExC) Cyan Coupler:

A 1:1:1 (mol ratio) mixture of:

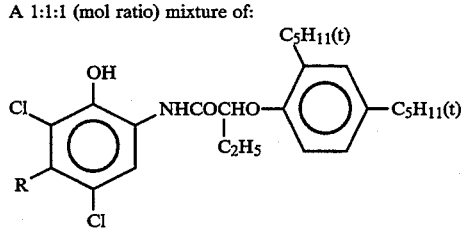

$R = CH_3$ and $R = C_2H_5$, and

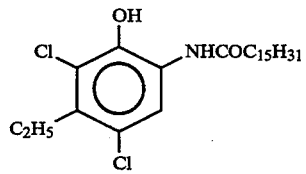

(Cpd-8) Dye Image Stabilizer:

A 1:1 (mol ratio) mixture of:

-continued
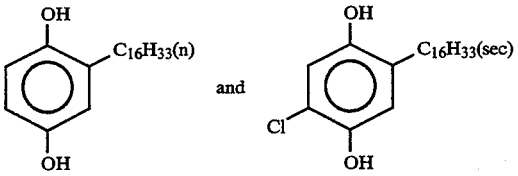
(Cpd-10) Antiseptics:
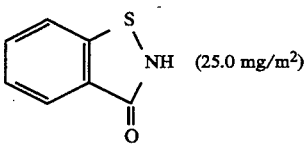
(25.0 mg/m$^2$)
(Cpd-11) Antiseptics:
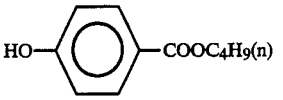
(50.0 mg/m$^2$)
(Solv-6) Solvent:
A 9:1 (weight ratio) mixture of:
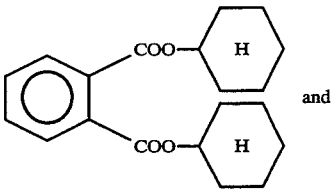
and
$(n)C_8H_{17}CHCH(CH_2)_7COOC_8H_{17}(n)$
O
(Oxonol Dyes)
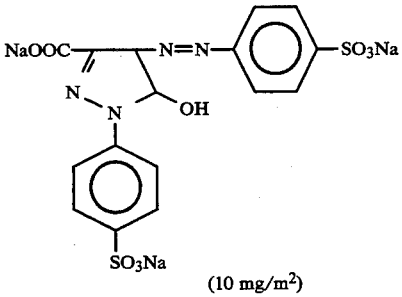
(10 mg/m$^2$)
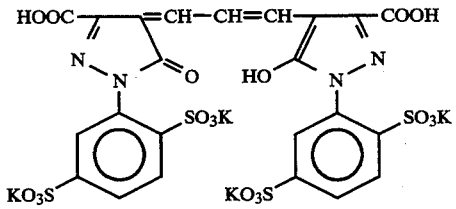
(10 mg/m$^2$)

-continued

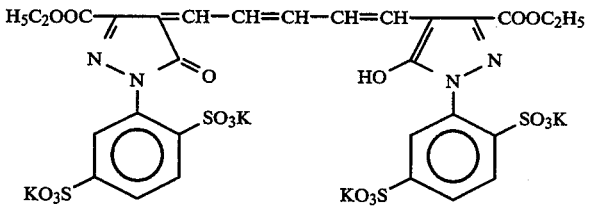

(40 mg/m²)

and

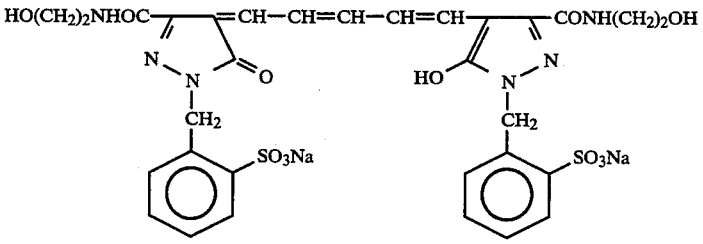

(20 mg/m²)

Then, the following color developer was prepared.

| (Color Developer) | |
|---|---|
| Water | 600 ml |
| Potassium Bromide | 0.015 g |
| Potassium Chloride | 3.1 g |
| Triethanolamine | 10.0 g |
| Potassium Carbonate | 27 g |
| Optical Whitening Agent (WHITEX 4B, trade name, made by Sumitomo Chemical Company, Limited) | 1.0 g |
| Preservative [Disodium-N,N-bis-(sulfonatoethyl)hydroxylamine] | 45 mmol |
| N-Ethyl-N-(β-methanesulfonamidoethyl)-3-methyl-4-aminoaniline Sulfate | 5.0 g |
| Water to make | 1 liter |
| pH (25° C.) | 10.05 |

The foregoing color developer was used as Sample 501 and by adding each of the compounds of formula (I) for use in this invention and the comparison compounds shown in Table 5 below to the color developer, Samples 502 to 508 were prepared.

Then, after adding 5 ppm of ferric ions and 150 ppm of calcium ions to each of the color developer samples, each sample was stored in a beaker for 20 days at 39° C. in a state that the open ratio was 0.10 $cm^{-1}$.

The foregoing multilayer color photographic paper B was subjected to a gradation exposure of a sensitometric 3 color separation filter using an sensitsmeter (Type FWH, made by Fuji Photo Film Co., Ltd.). The exposure was carried out such that the exposure amount became 250 CMS by the exposure time of 0.1 second.

After exposure, the color photographic paper was processed by the following steps using the foregoing color developer immediately after preparation (fresh solution) or the color developer stored for 20 days (stored solution).

| (Processing Steps) | | |
|---|---|---|
| Step | Temperature | Time |
| Color Development | 38° C. | 45 sec. |
| Blix | 35° C. | 25 sec. |
| Rinse (1) | 35° C. | 20 sec. |
| Rinse (2) | 35° C. | 20 sec. |
| Rinse (3) | 35° C. | 20 sec. |
| Drying | 80° C. | 60 sec. |

| (Blix Solution) | |
|---|---|
| Water | 400 ml |
| Ammonium Thiosulfate (700 g/liter) | 100 ml |
| Sodium Sulfite | 17 g |
| Iron(III) Ammonium Ethylenediaminetetraacetate | 55 g |
| Ethylenediaminetetraacetic Acid Disodium | 5 g |
| Ammonium Bromide | 40 g |
| Water to make | 1 liter |
| pH (25° C.) | 6.8 |

Rinse Solution

Ion-exchanged water (concentration of calcium and magnesium each was less than 3 ppm).

To the minimum density (Dmin) of yellow and the sensitivity of magenta (the logarithm log E of the exposure for giving a density of 0.5) in the case of processing with the fresh color developer (fresh solution), the increased amount (ADmin) of the minimum yellow density Dmin and the changed amount (AS) of the sensitivity of magenta, in the case of processing with the stored color developer, were calculated.

Also, the residual amount of the color developing agent in the stored color developer was determined by a high-speed liquid chromatography. Also, the occurrence of precipitations in the stored color developer was visually observed.

The results obtained are shown in Table 5 below.

TABLE 5

| No. | Chelate compound | (Amount) | Yellow ΔDmin | Magenta (ΔS) | Residual Amount of Developing Agent (%) | Formation of Precipitate* | Remarks |
|---|---|---|---|---|---|---|---|
| 501 | none | | +0.07 | −0.11 | 61 | BBB | Comparison |
| 502 | Sodium Hexametaphosphoric Acid | (1 g/liter) | +0.04 | −0.07 | 78 | BB | " |
| 503 | 1-Hydroxyethylidene-1,1-diphosphonic Acid (60%) | (1.6 g/liter) | +0.04 | −0.05 | 80 | BB | " |
| 504 | Ethylenediamine-tetraacetic Acid | (1 g/liter) | +0.06 | −0.08 | 65 | G | " |
| 505 | Nitrilotrimethylene-phosphonic Acid | (1 g/liter) | +0.05 | −0.07 | 75 | B | " |
| 506 | Compound 1 | (1 g/liter) | +0.02 | −0.03 | 87 | G | Invention |
| 507 | Compound 3 | (1 g/liter) | +0.01 | ±0 | 91 | G | " |
| 508 | Compound 4 | (1 g/liter) | +0.02 | −0.02 | 90 | G | " |

(*) G: No formation of precipitates.
B: Precipitates formed. (The larger the number of B is, the more the precipitation is severe.)

As is clear from the results shown in Table 5, it can be seen that according to the present invention, the values of ΔDmin and ΔS are small, which shows the deviation of the photographic property being restrained. Furthermore, in regard to the formation of precipitates, the formation is greatly improved in the examples of this invention as compared with the comparison examples. In particular, the conventional chelate compounds which show a large effect of preventing the formation of precipitates are inferior in the preservative property of the color developing agent, Also, conventional chelate compounds which show less decomposition of the developing agent are insufficient in the prevention of the formation of precipitates. However, it can be seen that the compounds of formula (I) for use in this invention provide a stable color developer without forming precipitates therein.

EXAMPLE 6

When the same evaluation as in Example 1 was carried out using Sample 201 in Example 2 of JP-A-2-90151 and photographic material 9 in Example 3 of JP-A-2-93641 (corresponding to U.S. Pat. No. 5,071,736), almost the same effects were obtained.

EXAMPLE 7

When disodium ethylenediaminetetraacetate in Developer (A) in Example 1 of JP-A-2-58041 was replaced with the same amount of Compound 3 of formula (I) for use in the present invention to provide Developer (B) and after storing the developer for 4 days at 40° C., Sample 1 in Example 1 of JP-A-2-58041 was subjected to running processing using the developer, the formation of precipitates was restrained.

EXAMPLE 8

A multilayer color photographic material A having the layers of the following compositions on a cellulose triacetate film support having a subbing layer was prepared.

Composition of Layers

The coating amount was shown by a g/m$^2$ unit of silver for a silver halide in an emulsion and colloidal silver, by a g/m$^2$ unit for couplers, additives and gelatin, and by mol number per mol of silver halide in the same layer for a sensitizing dye.

| | |
|---|---|
| Layer 1: Antihalation layer | |
| Black Colloidal Silver | 0.20 as Ag |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Layer 2: Interlayer | |
| Fine Grain Siiver Iodobromide (AgI 1.0 mol %, sphere-corresponding diameter 0.07 μm) | 0.15 as Ag |
| Gelatin | 1.00 |
| ExC-4 | $6.0 \times 10^{-2}$ |
| Cpd-3 | $2.0 \times 10^{-2}$ |
| Layer 3: 1st Red-Sensitive Emulsion Layer | |
| Silver Iodobromide in Emulsion (AgI 5.0 mol %, surface high AgI type, sphere-corresponding diameter 0.9 μm, variation coeff. of sphere-corresponding diameters 21%, tabular grains, ratio of diameter to thickness 7.5) | 0.42 as Ag |
| Silver Iodobromide in Emulsion (AgI 4.0 mol %, inside high AgI type, sphere-corresponding diameter 0.4 μm, variation coeff. of sphere-corresponding diameters 18%, tetradecahedral grains) | 0.40 as Ag |
| Gelatin | 1.90 |
| ExS-1 | $4.5 \times 10^{-4}$ mol |
| ExS-2 | $1.5 \times 10^{-4}$ mol |
| ExS-3 | $4.0 \times 10^{-5}$ mol |
| ExC-1 | 0.65 |
| ExC-3 | $1.0 \times 10^{-2}$ |
| ExC-4 | $2.3 \times 10^{-2}$ |
| ExC-6 | 0.020 |
| Solv-1 | 0.32 |
| Layer 4: 2nd Red-Sensitive Emulsion Layer | |
| Silver Iodobromide in Emulsion (AgI 8.5 mol %, inside high AgI type, sphere-corresponding diameter 1.0 μm, variation coeff. of sphere-corresponding diameters 25%, tabular grains, ratio of diameter to thickness 3.0) | 0.85 as Ag |
| Gelatin | 0.91 |
| ExS-1 | $3.0 \times 10^{-4}$ mol |
| ExS-2 | $1.0 \times 10^{-4}$ mol |
| ExS-3 | $3.0 \times 10^{-5}$ mol |
| ExC-1 | 0.13 |
| ExC-2 | $6.2 \times 10^{-2}$ |
| ExC-4 | $4.0 \times 10^{-2}$ |
| ExC-6 | 0.020 |
| Solv-1 | 0.10 |
| Layer 5: 3rd Red-Sensitive Emulsion Layer | |
| Silver Iodobromide in Emulsion (AgI 11.3 mol %, inside high AgI type, sphere-corresponding diameter 1.4 μm, varia- | 1.50 as Ag |

-continued

| | |
|---|---|
| tion coeff. of sphere-corresponding diameters 28%, tabular grains, ratio of diameter to thckness 6.0) | |
| Gelatin | 1.20 |
| ExS-1 | $2.0 \times 10^{-4}$ mol |
| ExS-2 | $6.0 \times 10^{-5}$ mol |
| ExS-3 | $2.0 \times 10^{-5}$ mol |
| ExC-2 | $8.5 \times 10^{-2}$ |
| ExC-5 | $7.3 \times 10^{-2}$ |
| Solv-1 | 0.12 |
| Solv-2 | 0.12 |
| Layer 6.: Interlayer | |
| Gelatin | 1.00 |
| Cpd-4 | $8.0 \times 10^{-2}$ |
| Solv-1 | $8.0 \times 10^{-2}$ |
| Layer 7: 1st Green-Sensitive Emulsion Layer | |
| Silver Iodobromide in Emulsion (AgI 5.0 mol %, surface high AgI type, sphere-corresponding diameter 0.9 μm, variation coeff. of sphere-corresponding diameters 21%, tabular grains, ratio of diameter to thickness 7.0) | 0.28 as Ag |
| Silver Iodobromide in Emulsion (AgI 4.0 mol %, inside high AgI type, sphere-corresponding diameter 0.4 μm, variation coeff. of sphere-corresponding diameters 18%, tetradecahedral grains) | 0.16 as Ag |
| Gelatin | 1.20 |
| ExS-4 | $5.0 \times 10^{-4}$ mol |
| ExS-5 | $2.0 \times 10^{-4}$ mol |
| ExS-6 | $1.0 \times 10^{-4}$ mol |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| Layer 8: 2nd Green-Sensitive Emulsion Layer | |
| Silver Iodobromide in Emulsion (AgI 8.5 mol %, inside high AgI type, sphere-corresponding diameter 1.0 μm, variation coeff. of sphere-corresponding diameters 25%, tabular grains, ratio of diameter to thickness 3.0) | 0.57 as Ag |
| Gelatin | 0.45 |
| ExS-4 | $3.5 \times 10^{-4}$ mol |
| ExS-5 | $1.4 \times 10^{-4}$ mol |
| ExS-6 | $7.0 \times 10^{-5}$ mol |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| Layer 9: Interlayer | |
| Gelatin | 0.50 |
| Solv-1 | $2.0 \times 10^{-2}$ |
| Layer 10: 3rd Green-Sensitive Emulsion Layer | |
| Silver Iodobromide in Emulsion (AgI 11.3 mol %, inside high AgI type, sphere-corresponding diameter 1.4 μm, variation coeff. of sphere-corresponding diameters 28%, tabular grains, ratio of diameter to thickness 6.0) | 1.30 as Ag |
| Gelatin | 1.20 |
| ExS-4 | $2.0 \times 10^{-4}$ mol |
| ExS-5 | $8.0 \times 10^{-5}$ mol |
| ExS-6 | $8.0 \times 10^{-5}$ mol |
| ExM-4 | $4.5 \times 10^{-2}$ |
| ExM-6 | $1.0 \times 10^{-2}$ |
| ExC-2 | $4.5 \times 10^{-3}$ |
| Cpd-5 | $1.0 \times 10^{-2}$ |
| Solv-1 | 0.25 |
| Layer 11: Yellow Filter Layer | |
| Gelatin | 0.50 |

-continued

| | |
|---|---|
| Cpd-6 | $5.2 \times 10^{-2}$ |
| Solv-1 | 0.12 |
| Layer 12: Interlayer | |
| Gelatin | 0.45 |
| Cpd-3 | 0.10 |
| Layer 13: 1st Blue-Sensitive Emulsion Layer | |
| Silver Iodobromide in Emulsion (AgI 2 mol %, uniform AgI type, sphere-corresponding diameter 0.55 μm, variation coeff. of sphere-corresponding diameters 25%, tabular grains, ratio of diameter to thickness 7.0) | 0.20 as Ag |
| Gelatin | 1.00 |
| ExS-7 | $3.0 \times 10^{-4}$ mol |
| ExY-1 | 0.60 |
| ExY-2 | $2.3 \times 10^{-2}$ |
| Solv-1 | 0.15 |
| Layer 14: 2nd Blue-Sensitive Emulsion Layer | |
| Silver Iodobromide in Emulsion (AgI 19.0 mol %, inside high AgI type, sphere-corresponding diameter 1.0 μm, variation coeff. of sphere-corresponding diameters 16%, octahedral grains) | 0.19 as Ag |
| Gelatin | 0.35 |
| ExS-7 | $2.0 \times 10^{-4}$ mol |
| ExY-1 | 0.22 |
| Solv-1 | $7.0 \times 10^{-2}$ |
| Layer 15: Interlayer | |
| Fine Grain Silver Iodobromide (AgI 2 mol %, uniform AgI type, sphere-corresponding diameter 0.13 μm) | 0.20 as Ag |
| Gelatin | 0.36 |
| Layer 16: 3rd Blue-Sensitive Emulsion Layer | |
| Silver Iodobromide in Emulsion (AgI 14.0 mol %, inside high AgI type, sphere-corresponding diameter 1.7 μm, variation coeff. of sphere-corresponding diameters 28%, tabular grains, ratio of diameter to thickness 5.0) | 1.55 as Ag |
| Gelatin | 1.00 |
| ExS-8 | $1.5 \times 10^{-4}$ mol |
| ExY-1 | 0.21 |
| Solv-1 | $7.0 \times 10^{-2}$ |
| Layer 17: 1st Protective Layer | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Layer 18: 2nd Protective Layer | |
| Fine Grain Silver Chloride (sphere-corresponding diameter 0.07 μm) | 0.36 as Ag |
| Gelatin | 0.70 |
| B-1 (diameter 1.5 μm) | $2.0 \times 10^{-2}$ |
| B-2 (diameter 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

The sample further contained 1,2-benzisothizaolin-3-one (200 ppm in average to gelatin), n-butyl-p-hydroxybenzoate (about 1,000 ppm to gelatin), and 2-phenoxyethanol (about 10,000 ppm to gelatin). Furthermore, the sample contains B-4, B-5, W-2, W-3, F1, F-2, F-3, F-4, F-5, F-6, F-7, F-8, F-9, F-10, F-11, F-12, F-13, an iron salt, a lead salt, a gold salt, a platinum salt, an iridium salt, and a rhodium salt.

The compounds used for preparing the foregoing sample are as follows.

UV-1
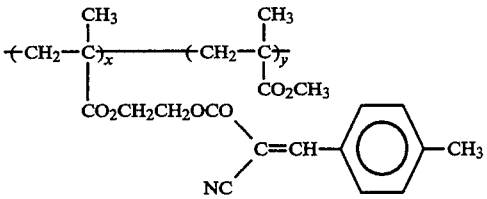
x/y = 7/3 (by weight)
UV-2
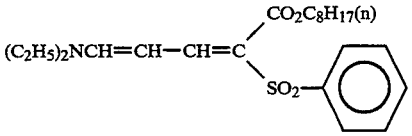
ExC-1
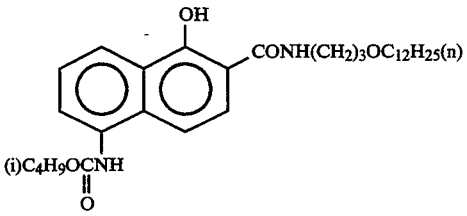
ExC-2
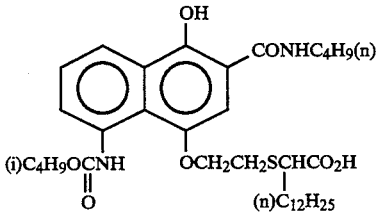
ExC-3
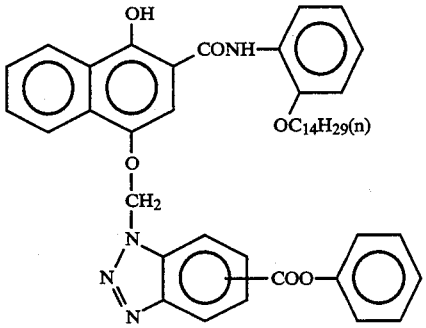
ExC-4
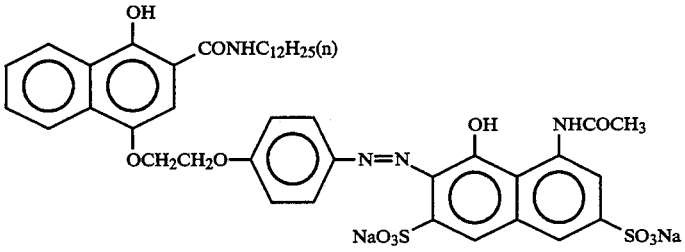
ExC-5
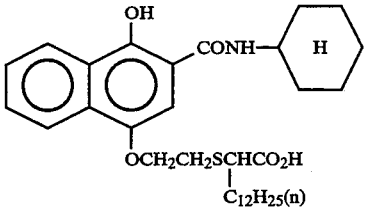
ExC-6
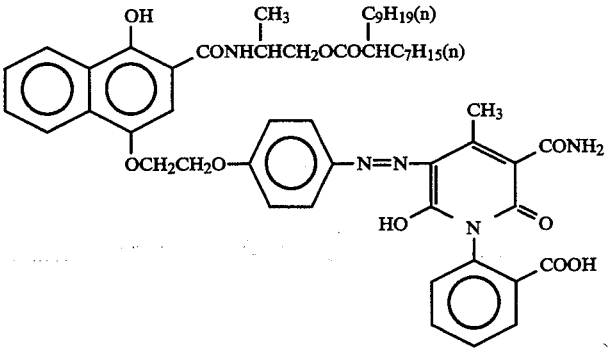

-continued
ExM-1
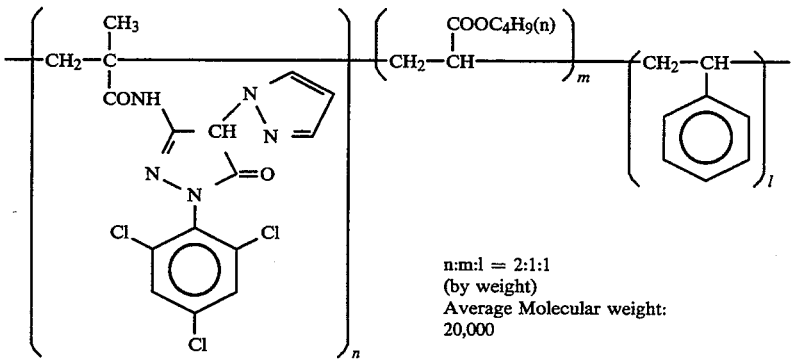
n:m:l = 2:1:1
(by weight)
Average Molecular weight:
20,000
ExM-2
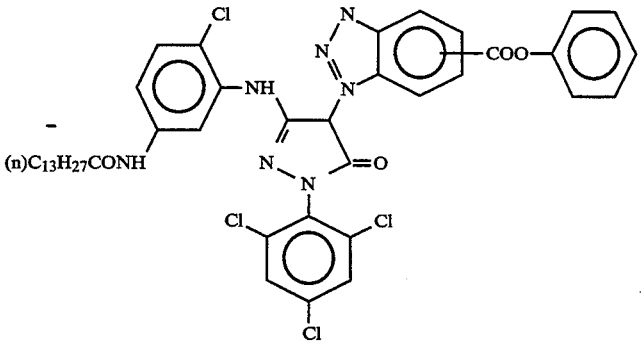
ExM-3
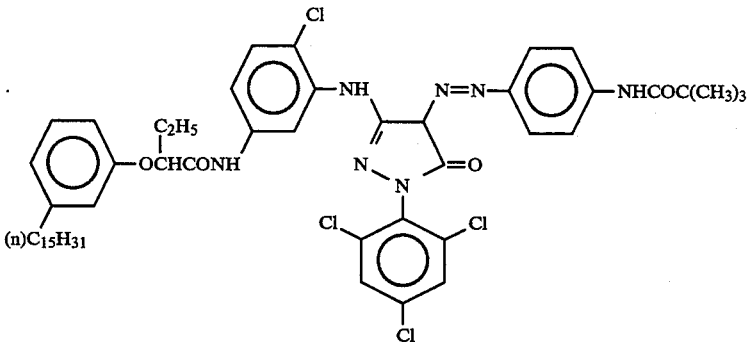
ExM-4
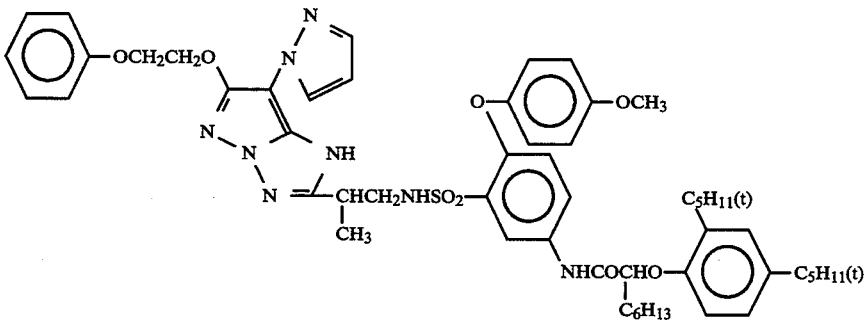

-continued
ExM-5
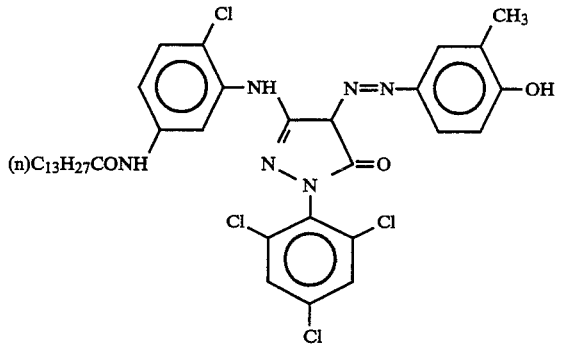
ExM-6
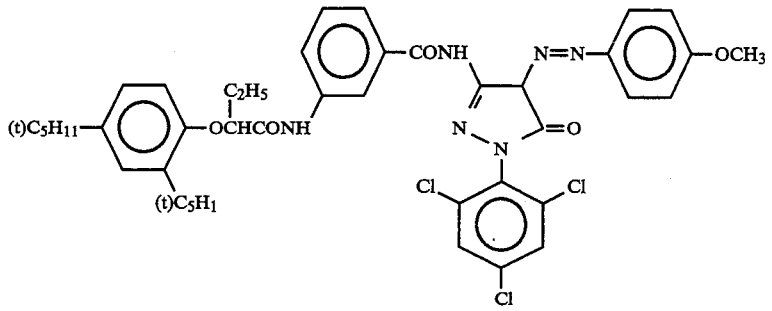
ExY-1
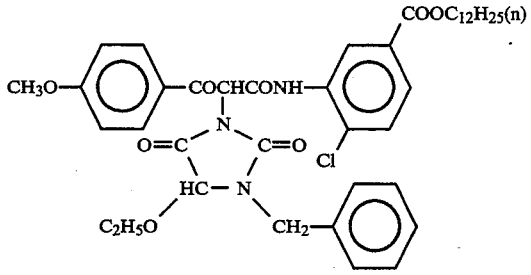
ExY-2
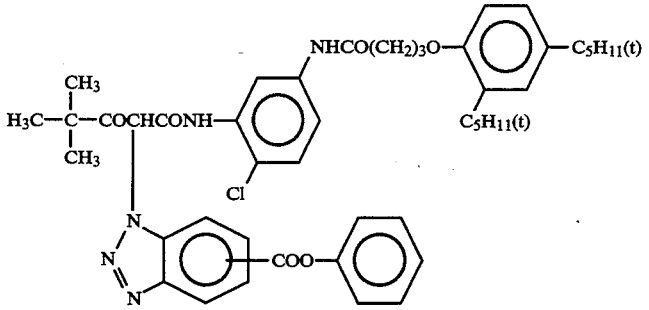
Cpd-1
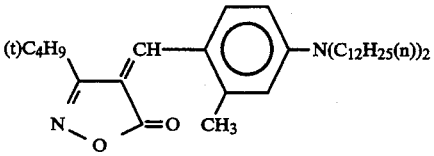
Cpd-2
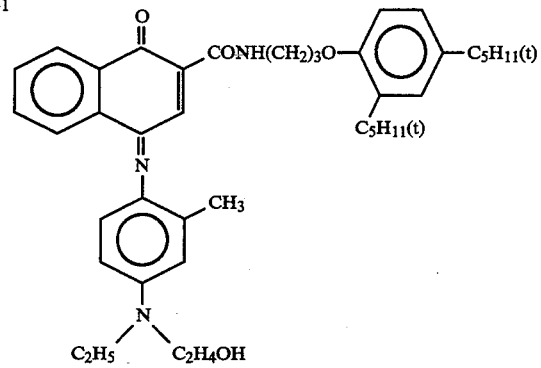

-continued
Cpd-3
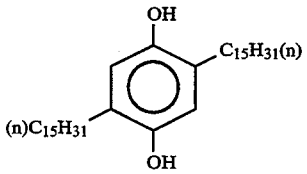
Cpd-4
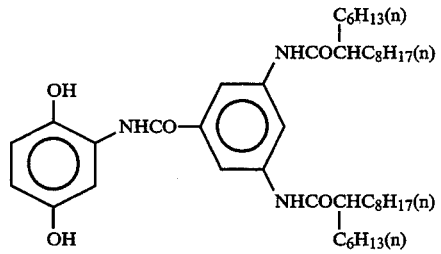
Cpd-5
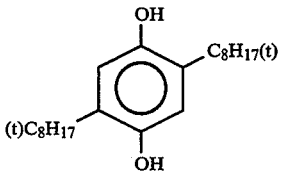
Cpd-6
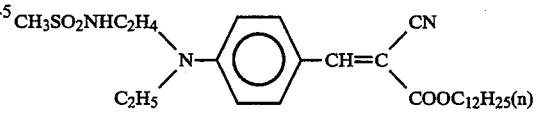
Cpd-7
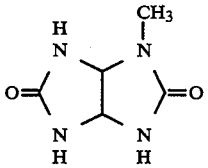
Solv-1
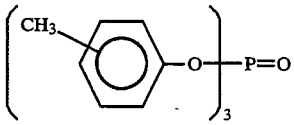
Solv-2
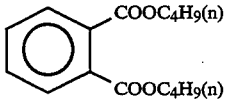
Solv-3
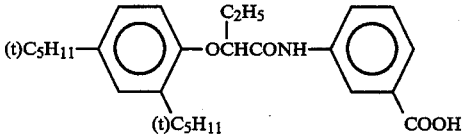
ExS-1
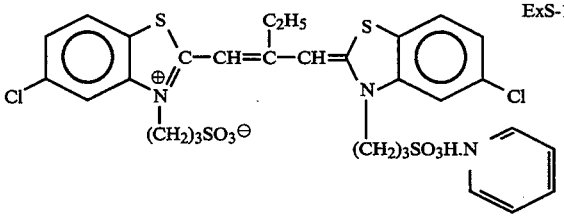
ExS-2
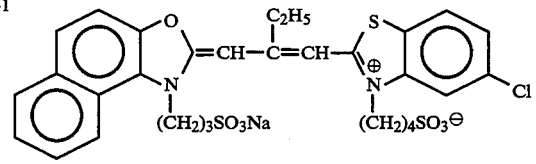
ExS-3
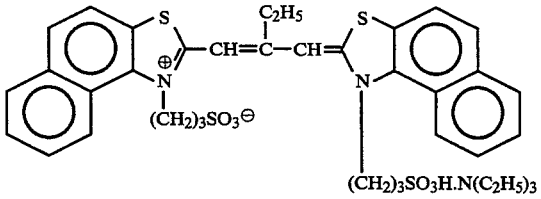
ExS-4
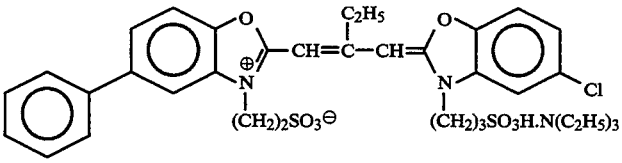
ExS-5
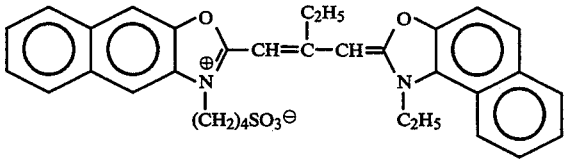

-continued
ExS-6
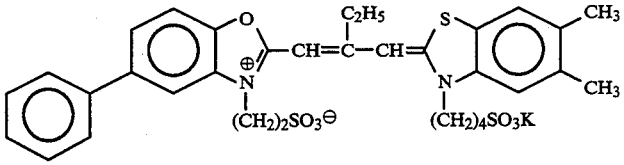
ExS-7
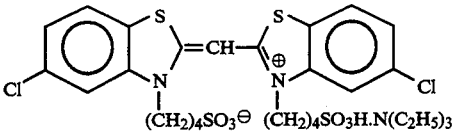
ExS-8
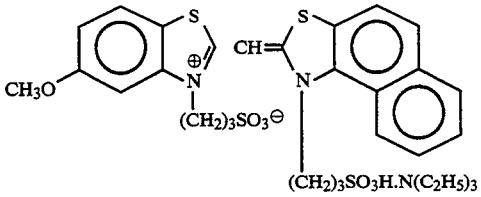
B-1
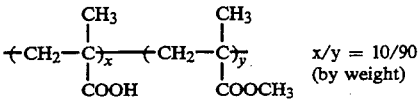
x/y = 10/90 (by weight)
B-2
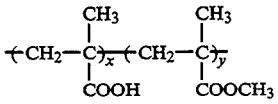
x/y = 40/60 (by weight)
B-3
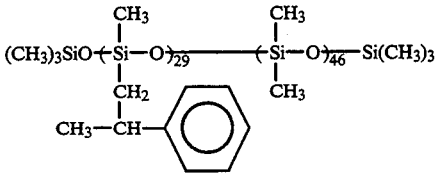
B-4
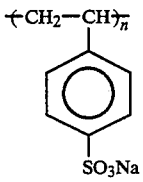
B-5
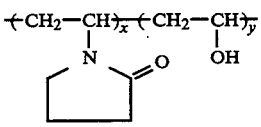
x/y = 70/30 (by weight)
W-1
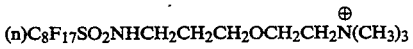
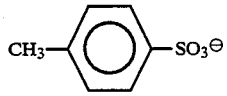
W-2
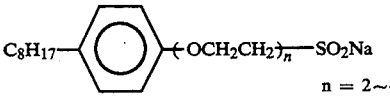
W-3
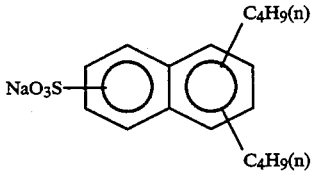
H-1
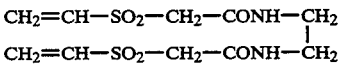
F-1
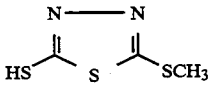
F-2
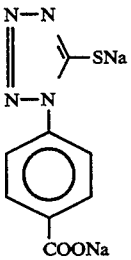
F-3
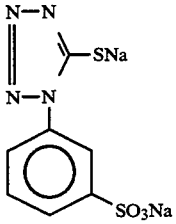
F-4
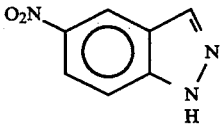
F-5
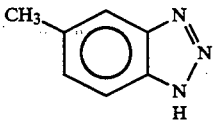

-continued

F-6

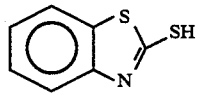

F-7

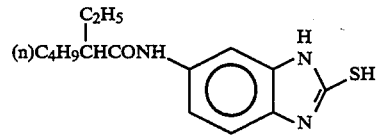

F-8

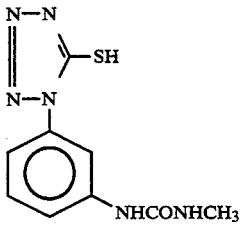

F-9

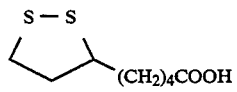

F-10

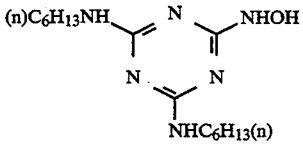

F-11

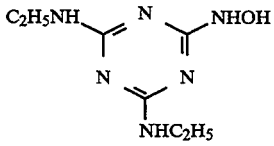

F-12

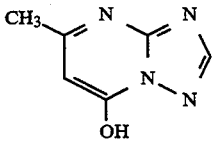

F-13

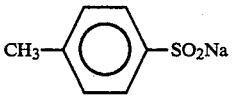

The multilayer color photographic material A thus prepared was sliced into width of 35 mm, subjected to a wedge exposure of white light (color temperature of the light source 4800° K.), and processed by the following processing steps using an cine automatic processor. In this case, however, the multilayer color photographic material A for evaluating the performance was processed after processing an imagewise-exposed sample until the accumulated amount of the replenisher for the color developer became thrice the tank volume.

| Step | Time | Temperature (°C.) | Replenisher Amount* (ml) | Tank Volume (liter) |
|---|---|---|---|---|
| Color Development | 3 min. | 37.8 | 23 | 10 |
| Bleach | 50 sec. | 38.0 | 5 | 5 |
| Fix | 100 sec. | 38.0 | 30 | 10 |
| Wash (1) | 30 sec. | 38.0 | — | 5 |
| Wash (2) | 20 sec. | 38.0 | 30 | 5 |
| Stabilization | 20 sec. | 38.0 | 20 | 5 |
| Drying | 1 min. | 55 | | |

(*): The replenishing amount is an amount per 1 meter × 35 mm.

Wash was a countercurrent system from (2) to (1).

In addition, the carried amount of the color developer into the bleaching step and the carried amount of the fixing solution into the washing step were 2.5 ml and 2.0 ml, respectively per a meter length×35 mm width of the color photographic material. In the aeration condition of the bleaching solution, the bleaching carried was out while bubbling at 200 ml/min through a conduit portion having a large number of fine holes having a diameter of 0.2 mm equipped to the bottom of the bleaching solution tank.

Also, each crossover time was 5 seconds, which was included in the processing time of the previous step.

Next, the compositions of the processing solutions are shown below.

| | Mother Liquid | Replenisher |
|---|---|---|
| (Color Developer) | | |
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.9 g |
| Potassium Carbonate | 30.0 g | 30.0 g |
| Potassium Bromide | 1.4 g | — |
| Potassium Iodide | 1.5 mg | — |
| Hydroxylamine Sulfate | 2.4 g | 3.6 g |
| 4-(N-Ethyl-N-β-hydroxyethyl-amino)-2-methylaniline Sulfate | 4.5 g | 6.4 g |
| Water to make | 1 liter | 1 liter |
| pH | 10.05 | 10.10 |
| (Bleach Solution) | | |
| Iron Nitrate.$9H_2O$ | 0.35 mol | 0.53 mol |
| Chelate Compound (shown in Table 6) | 0.55 mol | 0.83 mol |
| Ammonium Bromide | 100 g | 150 g |
| Ammonium Nitrate | 20 g | 30 g |
| Glycolic Acid | 55 g | 83 g |
| Water to make | 1 liter | 1 liter |
| pH | 5.0 | 5.0 |

In this case, the chelate compound shows an organic acid which reacts with iron nitrate-9H20 to form an organic acid ferric ammonium salt acting as a bleaching agent. (The same in the following examples).

(Fix Solution) Mother Liquid=Replenisher Same as the fixing solution in Example 1.

(Wash Water) Mother Liquid=Replenisher Same as wash water in Example 1.

(Stabilization Solution) Mother Liquid=Replenisher Same as the stabilization solution in Example 1.

For the multilayer color photographic material A processed as described above, the residual amount of silver at the maximum color density portion was measured by a fluorescent X-ray analysis.

Also, on each of these multilayer color photographic materials A thus processed, the density was measured and from the characteristic curve, each of the Dmin Values measured by green light (G light) was read.

Then, the bleaching solution was replaced with the bleaching solution having the following formula as a standard bleaching solution giving no bleaching fog and the multilayer color photographic material A was processed at a bleaching time of 390 seconds, a processing temperature of 38° C., and at a replenishing amount of 25 ml per 35 mm×1 meter of the color photographic material, while not changing the other conditions.

| (Standard Bleach Solution) | Mother Liquid | Replenisher |
|---|---|---|
| Ferric Sodium Ethylenediaminetertraacetate Trihydrate | 100.0 g | 120.0 g |
| Disodium Ethylenediaminetertraacetate | 10.0 g | 11.0 g |
| Ammonium Bromide | 100 g | 120 g |
| Ammonium Nitrate | 30.0 g | 35.0 g |
| Aqueous Ammonia (27%) | 6.5 ml | 4.0 ml |
| Water to make | 1 liter | 1 liter |
| pH | 6.0 | 5.7 |

On each multilayer color photographic material processed using the foregoing standard bleach solution, the density was measured and from the characteristics curve, Dmin was read.

The difference ΔDimn value between the Dmin value of each multilayer color photographic material A obtained in foregoing processing and the standard Dmin value obtained using the standard bleach solution was determined. In addition, the Dmin value obtained using the standard bleach solution was 0.60.

Bleach fog (ADmin)=(Dmin with each sample)−(Dmin with the standard bleach solution)

Then, the foregoing multilayer color photographic material A thus processed was stored under the following condition and the increase of stains upon storing the sample after processing was determined by the density change of Dmin at the uncolored portion before and after storing.

Dark, wet, heat conditions: 60° C., 70% RH, for 4 weeks.

Stain increase (AD)=(Drain after storage)−(Drain before storage)

The results obtained are shown in Table 6.

TABLE 6

| No. | Chelating Compound | Residual Amount of Silver (μg/cm²) | Bleach Fog ΔDmin(G) | Stain Increase ΔD(G) | Remarks |
|---|---|---|---|---|---|
| 801 | Comparison Compound A | 15.2 | 0.00 | 0.35 | Comparative |
| 802 | Compound B | 4.3 | 0.25 | 0.17 | " |
| 803 | Compound 1 | 3.8 | 0.06 | 0.08 | Invention |
| 804 | Compound 2 | 3.1 | 0.02 | 0.06 | " |
| 805 | Compound 4 | 3.0 | 0.07 | 0.07 | " |
| 806 | Compound 9 | 4.0 | 0.10 | 0.09 | " |
| 807 | Compound 17 | 3.3 | 0.09 | 0.09 | " |
| 808 | Compound 20 | 3.3 | 0.06 | 0.08 | " |
| 809 | Compound 24 | 4.0 | 0.12 | 0.11 | " |

Comparison Compounds A and B in Table 6 are shown below.

Comparison Compound A:

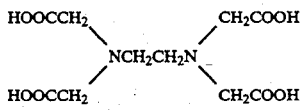

Comparison Compound B:

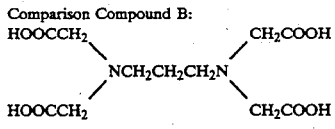

From the results shown in Table 6, it can be seen that the metal chelate compounds for use in this invention can reduce the residual amount of silver and show excellent effects in the bleach fog and stains upon storing color images after processing as compared with the case of using the comparison compounds.

EXAMPLE 9

Processing solutions having the following compositions were prepared.

| | |
|---|---|
| (Color Developer) | |
| Water | 600 ml |
| Ethylenediamine-N,N,N',N'-tetramethylenephosphonic Acid | 2.0 g |
| Potassium Bromide | 0.015 g |
| Potassium Chloride | 3.1 g |
| Triethanolamine | 10.0 g |
| Potassium Carbonate | 27 g |
| Optical Whitening Agent (WHITE X-4B, trade name, made by Sumitomo Chemical Company, Limited) | 1.0 g |
| Diethylhydroxylamine | 4.2 g |
| N-Ethyl-N-(β-methanesulfonamidoethyl)-3-methyl-4-aminoaniline Sulfate | 5.0 g |
| Water to make | 1 liter |
| pH (25° C.) | 10.05 |
| (Blix Solution) | |
| Water | 400 ml |
| Ammonium Thiosulfate (700 g/liter) | 100 ml |
| Sodium Thiosulfate | 17 g |
| Iron Chloride | 0.50 mol |
| Chelate compound (shown in Table 7) | 0.55 mol |
| Ammonium Bromide | 40 g |
| Water to make | 1 liter |
| pH (25° C.) | 6.8 |

Rinse Solution

Ion-exchanged water (concentrations of calcium and magnesium each lower than 3 ppm)

The multilayer color photographic paper B prepared in Example 5 was processed in the following processing steps.

| (Processing Steps) | | |
|---|---|---|
| Step | Temperature | Time |
| Color Development | 38° C. | 45 sec. |
| Blix | 35° C. | 25 sec. |
| Rinse (1) | 35° C. | 20 sec. |
| Rinse (2) | 35° C. | 20 sec. |
| Rinse (3) | 35° C. | 20 sec. |
| Drying | 80° C. | 60 sec. |

Furthermore, the multilayer color photographic paper B uniformly exposed such that the gray density became 1.5 was processed by the same manner as above and the residual silver amount in the maximum density portion of each sample wa§determined by a fluorescent X-ray analysis.

The results obtained are shown in Table 7.

TABLE 7

| No. | Chelate Compound | Residual Amount of Silver ($\mu g/cm^2$) | Remarks |
|---|---|---|---|
| 901 | Comparison Compound A | 14.0 | Comparison |
| 902 | Compound 1 | 2.8 | Invention |
| 903 | Compound 3 | 1.9 | " |
| 904 | Compound 4 | 1.7 | " |
| 905 | Compound 20 | 2.7 | " |

Comparison Compound A is the same Comparison Compound A in Example 8.

From the above results in Table 7, it can be seen that in the case of using the metal chelate compounds in this invention, the residual silver amount is less than the case of using Comparison Compound A.

EXAMPLE 10

The multilayer color photographic material A as in Example 8 was exposed to white light of a color temperature of 4800° K. through a wedge and processed by the following processing steps.

Processing Steps

| Step | Time | Temperature (°C.) | Replenisher Amount* (ml) | Tank Volume (liter) |
|---|---|---|---|---|
| Color Development | 1 min. | 48 | 10 | 2 |
| Bleach | 20 sec. | 48 | 10 | 1 |
| Fix | 40 sec. | 48 | 30 | 1 |
| Wash | 20 sec. | 40 | 30 | 1 |
| Drying | 40 sec. | 60 | | |

*The replenishing amount is per 1 meter × 35 mm of the color photographic paper.

| | Mother Liquid | Replenisher |
|---|---|---|
| (Color Developer) | | |
| Diethylenetriaminepenta-acetic Acid | 2.2 g | 2.2 g |
| 1-Hydroxyethylidene-1,1-diphosphonic Acid | 3.0 g | 3.2 g |
| Sodium Sulfite | 4.1 g | 4.9 g |
| Potassium Carbonate | 40 g | 40 g |
| Potassium Bromide | 1.4 g | 0.4 g |
| Potassium Iodide | 1.3 mg | — |
| 2-Methoxy-4-[N-ethyl-N-(β-hydroxyethylamino]aniline Sulfate | 6.9 g | 9.2 g |
| Water to make | 1 liter | 1 liter |
| pH (adjusted with 50% KOH) | 10.05 | 10.25 |
| (Bleach Solution) | | |
| Chelate Compound (shown in Table 8) | 0.47 mol | 0.67 mol |
| Iron Nitrate.$9H_2O$ | 0.3 mol | 0.43 mol |
| Ammonium Bromide | 80 g | 114 g |
| Ammonium Nitrate | 15 g | 21.4 g |
| Acetic Acid (90%) | 42 g | 60 g |
| Water to make | 1 liter | 1 liter |
| pH | 4.3 | 3.8 |

| (Fixing Solution) | Mother Liquid = Replenisher |
|---|---|
| Aqueous Ammonium Thiosulfate Solution (700 g/liter) | 280 ml |
| 1-Hydroxyethylidene,1,1-diphosphonic Acid | 10 g |
| Ammonium Sulfite | 28 g |
| Water to make | 1 liter |
| pH | 7.8 |

The processing was carried out until the accumulated amount of each replenisher became twice the tank volume, and at that time the processing property was evaluated.

The evaluation of the processing property was carried out by measuring the residual amount at the maximum color density portion, measuring the bleach fog, and measuring the increase of stains under the dark, wet, and heat condition as in Example 8.

The results obtained are shown in Table 8.

TABLE 8

| No. | Chelating Compound | Residual Amount of Silver ($\mu g/cm^2$) | Bleach Fog ΔDmin(G) | Stain Increase ΔD(G) |
|---|---|---|---|---|
| 1001 | Comparison Compound A | 30.0 | 0.03 | 0.32 |
| 1002 | Comparison Compound B | 7.1 | 0.35 | 0.28 |
| 1003 | Compound 1 | 5.3 | 0.14 | 0.13 |
| 1004 | Compound 3 | 4.9 | 0.04 | 0.07 |
| 1005 | Compound 4 | 4.6 | 0.09 | 0.10 |
| 1006 | Compound 20 | 5.2 | 0.12 | 0.13 |

The comparison compounds are the same those in Example 8.

As is clear from the results shown in Table 8, it can be seen that the bleaching solutions containing the metal chelate compounds for use in this invention as the bleaching agents are excellent in the desilvering property, the prevention of bleach fog, and the prevention of stains after processing as compared with the comparison bleach solutions.

Also, the same evaluation as above was carried out except that the foregoing bleaching solution was replaced with the bleaching solution having the following formula.

| (Bleaching Solution) | | |
|---|---|---|
| | Mother Liquid | Replenisher |
| Metal Chelate Compound (shown in Table 9) | 0.3 mol | 0.43 mol |
| Ammonium Bromide | 80 g | 114 g |
| Ammonium Nitrate | 15 g | 21.4 g |
| Nitric Acid (90%) | 42 g | 60 g |
| Water to make | 1 liter | 1 liter |

The results obtained are shown in Table 9.

TABLE 9

| No. | Metal Chelate Compound | Residual Silver ($\mu g/cm^2$) | Bleach Fog ΔDmin (G) | Increase of Stain After Processing ΔD(G) | Remarks |
|---|---|---|---|---|---|
| 1011 | Comparison Compound C | 30.0 | 0.02 | 0.33 | Comparison |
| 1012 | Comparison Compound D | 7.1 | 0.35 | 0.28 | Comparison |
| 1013 | Compound K-1 | 3.4 | 0.01 | 0.13 | Invention |
| 1014 | Compound K-3 | 3.0 | 0.04 | 0.20 | " |
| 1015 | Compound K-6 | 5.3 | 0.03 | 0.18 | " |
| 1016 | Compound K-8 | 5.5 | 0.03 | 0.17 | " |
| 1017 | Compound K-10 | 3.6 | 0.01 | 0.13 | " |

The comparison compounds C and D shown in Table 9 are as shown below.

Comparison Compound C:

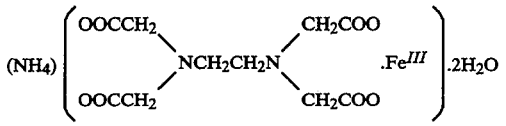

Comparison Compound D:

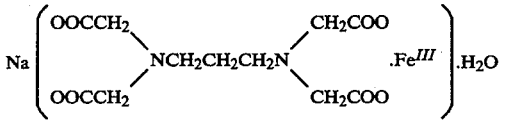

As is clear from Tables 8 and 9, it can be seen that even when the metal chelate compound for use in this invention is used as an isolated compound, the processing solution prepared using the compound is excellent in the desilvering property, the bleach fog, and stains after processing.

EXAMPLE 11

The multilayer color photographic material prepared as in Example 8 was exposed to white light having a color temperature of 4800° K. through an optical wedge and then processed by the following processing steps. In this case, for determining the adaptibility for quickening after bleaching step, an automatic processor having shortened racks was used and processing for shortening processing time was also carried out. Processing (1) is a process wherein the processing time for bleaching, blixing, and fixing each is 50 seconds, and processing (2) is the process wherein the processing time for bleaching and blixing is shortened to 20 seconds and the processing time for fixing is shortened to 30 seconds.

| Step | Time | Temperature (°C.) | Replenisher Amount* (ml) | Tank Volume (liter) |
|---|---|---|---|---|
| Color Development | 3 min. 15 sec. | 38.0 | 23 | 15 |
| Bleach | (1) 50 sec. or (2) 20 sec. | 38.0 | 5 | 5 |
| Blix | (1) 50 sec. or (2) 20 sec. | 38.0 | — | 5 |
| Fix | (1) 50 sec. or (2) 30 sec. | 38.0 | 16 | 5 |

-continued

| Step | Time | Temperature (°C.) | Replenisher Amount* (ml) | Tank Volume (liter) |
|---|---|---|---|---|
| Wash (1) | 30 sec. | 38.0 | — | 3 |
| Wash (2) | 20 sec. | 38.0 | 34 | 3 |
| Stabilization | 20 sec. | 38.0 | 20 | 3 |
| Drying | 60 sec. | 55 | | |

(*)The replenishing amount is the amount per 35 mm × 1 meter of the color photographic material.

Wash step was a countercurrent system of from wash (2) to wash (1) and all of the overflow liquid of wash water was introduced into the fix bath.

Replenishing to the blix bath was carried out as follows. The upper portion of the bleach tank was connected to the bottom of the blix tank by pipe and the upper portion of the fix tank was connected to the bottom of the blix tank by pipes in the automatic processor, whereby all of the overflow liquids formed by supplying each replenisher to the bleach bath and the fix bath were introduced into the blix bath. In addition, the carrying over amounts of the color developer into the bleaching step, the bleaching solution into the blixing step, the blix solution into the fixing step, and the fixing solution into the wash step were 2.5 ml, 2.0 ml, 2.0 ml, and 2.0 ml respectively per 35 mm × 1 meter of the color photographic material.

Also, the crossover time in each case was 5 seconds, which was included in the processing time of the preceding step. The. processing was continued until the accumulated amount of each replenisher in each processing bath tank became thrice the tank volume. The following processing performance was the result of processing carried out at that time. Also, to the bleach bath tank was equipped a subtank of aeration for the bleaching solution and the processing was carried out while blowing air of about 200 ml/min.

Next, the compositions of the processing solutions used are shown below.

| | Mother Liquid | Replenisher |
|---|---|---|
| (Color Developer) | | |
| Diethylenediaminepentaacetic Acid | 2.0 g | 2.2 g |
| 1-Hydroxyethylidene-1,1-diphosphonic Acid | 3.3 g | 3.3 g |
| Sodium sulfite | 3.9 g | 5.2 g |
| Potassium Carbonate | 37.5 g | 39.0 g |
| Potassium Bromide | 1.4 g | 0.4 g |
| Potassium Iodide | 1.3 mg | — |
| Hydroxylamine Sulfate | 2.4 g | 3.3 g |
| 2-Methyl-4-[N-ethyl-N-(β-hydroxyethyl)amino]aniline Sulfate | 4.5 g | 6.1 g |
| Water to make | 1 liter | 1 liter |
| pH | 10.05 | 10.15 |
| (Bleach Solution) | | |
| Chelate Compound (shown in Table 10) | 0.47 mol | 0.67 mol |
| Iron Nitrate.$9H_2O$ | 0.3 mol | 0.43 mol |
| Ammonium Bromide | 84.0 g | 120.0 g |
| Ammonium Nitrate | 17.5 g | 25.0 g |
| Hydroxyacetic Acid | 63.0 g | 90.0 g |
| Acetic Acid | 33.2 g | 47.4 g |
| Water to make | 1 liter | 1 liter |
| pH (adjusted with aqueous ammonia) | 3.60 | 2.80 |

Mother Liquid of Blix Solution

A 15:85 mixture of the foregoing bleach tank liquid and the following tank liquid of the fixing solution.

| | Mother Liquid | Replenisher |
|---|---|---|
| Ammonium Sulfite | 19.0 g | 57.0 g |
| Aqueous Ammonium Thiosulfate Solution (700 g/liter) | 280 ml | 840 ml |
| Imidazole | 28.5 g | 85.5 g |
| Ethylenediaminetetraacetic Acid | 12.5 g | 37.5 g |
| Water to make | 1 liter | 1 liter |
| pH (adjusted with aqueous ammonia or acetic acid | 7.40 | 7.45 |

(Wash Water)Mother Liquid=Replenisher Same as the wash water in Example 1

(Stabilization Solution) Mother Liquid=Replenisher Same as the stabilization solution in Example 9.

For the multilayer color photographic material A processed by the above processing steps, the residual silver amount at the maximum density portion was measured by a fluorescent X-ray analysis method. Also, the bleach fog was evaluated as in Example 8.

Then, the foregoing sample processed was stored for 4 weeks at 60° C., 70% RH and thereafter, the increase of the green density (G density) at the Dmin portion was determined.

The results obtained are shown in Table 10.

TABLE 10

| No. | Chelate Compound | Process | Residual Silver Amount ($\mu g/cm^2$) (a) | (b) | Stain Increase ΔD(G) (a) | (b) | Remarks |
|---|---|---|---|---|---|---|---|
| 1101 | Comparison Compound A | (1) | 12 | 18 | 0.16 | 0.36 | Comp. |
| | | (2) | 20 | 75 | 0.22 | 0.44 | |
| 1102 | Compound B | (1) | 3.2 | 4.3 | 0.07 | 0.18 | " |
| | | (2) | 6.5 | 7.1 | 0.12 | 0.25 | |
| 1103 | Compound 1 | (1) | 3.3 | 4.0 | 0.09 | 0.10 | Inv. |
| | | (2) | 4.5 | 5.1 | 0.10 | 0.11 | |
| 1104 | Compound 3 | (1) | 2.7 | 3.4 | 0.06 | 0.07 | " |
| | | (2) | 3.0 | 3.7 | 0.07 | 0.09 | |
| 1105 | Compound 4 | (1) | 2.5 | 3.1 | 0.07 | 0.09 | " |
| | | (2) | 2.7 | 3.4 | 0.09 | 0.10 | |
| 1106 | Compound 20 | (1) | 3.1 | 3.9 | 0.09 | 0.11 | " |
| | | (2) | 3.7 | 4.5 | 0.11 | 0.12 | |

(a): At starting
(b): After running processing.

The comparison compounds are the same as in Example 8.

From the results shown in Table 10, it can be seen that the processing solution having a bleaching ability containing the metal chelate compound for use in this invention can reduce the residual amount of silver and also shows almost no increase of bleaching fog and stains after processing, and thus shows an excellent performance as compared with the processing solution containing the comparative compound.

EXAMPLE 12

The following processing solutions were prepared.

| | Tank Liquid | Replenisher |
|---|---|---|
| (Color Developer) | | |
| Water | 700 ml | 700 ml |
| Diethylenetriaminepentaacetic Acid | 0.4 g | 0.4 g |
| N,N,N-Tris(methylenephosphonic Acid) | 4.0 g | 4.0 g |
| 1,2-Dihydroxybenzene-4,6-disulfonic Acid Disodium Salt | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Optical Whitening Agent (WHITEX 4B, trade name, made by Sumitomo Chemical Company, Limited) | 1.0 g | 3.0 g |
| Sodium Sulfite | 0.1 g | 0.1 g |
| N,N-Bis(sulfoethyl)hydroxylamine | 10.0 g | 13.0 g |
| N-ethyl-N-[β-methanesulfonamidoethyl)-3-methyl-4-aminoaniline Sulfate | 5.0 g | 11.5 g |
| Water to make | 1 liter | 1 liter |
| pH (25° C.) | 10.10 | 11.10 |
| (Blix Solution) | | |
| Water | 600 ml | 600 ml |
| Ammonium Thiosulfate (700 g/liter) | 100 ml | 250 ml |
| Ammonium sulfite | 40 g | 100 g |
| Chelating Compound (shown in Table 11) | 0.166 mol | 0.407 mol |
| Iron Nitrate.$9H_2O$ | 0.138 mol | 0.339 mol |
| Ethylenediaminetetraacetic Acid | 5 g | 12.5 g |
| Ammonium Bromide | 40 g | 75 g |
| Nitric Acid (67%) | 30 g | 65 g |
| Water to make | 1 liter | 1 liter |
| pH (25° C.) adjusted with acetic acid or aqueous ammonia | 5.8 | 5.6 |

For determining the residual silver amount after processing, the multilayer color photographic paper B as prepared in Example 5 was uniformly exposed such that the gray density became 2.2 and processed by the following processing steps. The residual silver amount was measured by a fluorescent X-ray analysis method.

Also, for determining the increase of stain after processing, the multilayer color photographic paper B was subjected to a gradation exposure through a wedge and processed as above. The sample after processing was stored for one week at 80° C., 70% RH and the increase of stain before and after the storage was determined.

The processing was started using the foregoing processing solutions by the following processing steps after placing each tank solution in each processing tank and then the processing was continued while adding each replenisher to each tank according to each processed amount. The processing was carried out continuously until the accumulated amount of each replenisher became thrice the volume of each tank. The results of the processing conducted at the time when the accumulated solution reached the definite amount are shown in Table 11.

| (Processing Steps) | | | | |
|---|---|---|---|---|
| Step | Temp. (°C.) | Time (sec.) | Replenishing Amount* (ml) | Tank Volume (liter) |
| Color Development | 39 | 45 | 70 | 20 |
| Blix | 35 | (1) 45<br>(2) 20 | 60** | 20 |
| Rinse (1) | 35 | 20 | — | 10 |
| Rinse (2) | 35 | 20 | — | 10 |
| Rinse (3) | 35 | 20 | 360 | 10 |
| Drying | 80 | 60 | | |

(*): Replenishing amount per square meter of the sample processed. (Countercurrent system of from rinse (3) to (1)).
(**): In addition to 60 ml described above, 120 ml per square meter of the color photographic material was introduced into the blix bath from Rinse (1).

For the rinse, the wash water in Example 1 was used.

TABLE 11

| No. | Chelate Compound | Blix Time | Residual Silver Amount ($\mu g/cm^2$) | Stain Increase ΔD | Remarks |
|---|---|---|---|---|---|
| 1201 | Comparison Compound A | 45 sec. | 2.6 | 0.11 | Comp. −1 |
| | | 20 sec. | 8.0 | 0.20 | |
| 1202 | Compound B | 45.sec. | 10.0 | 0.03 | Comp. −2 |
| | | 20 sec. | 20.2 | 0.04 | |
| 1203 | Compound 1 | 45 sec. | 1.6 | 0.04 | Inv. |
| | | 20 sec. | 2.1 | 0.05 | |
| 1204 | Compound 3 | 45.sec. | 0.9 | 0.03 | " |
| | | 20 sec. | 1.4 | 0.04 | |
| 1205 | Compound 4 | 45 sec. | 0.7 | 0.04 | " |
| | | 20 sec. | 1.1 | 0.05 | |
| 1206 | Compound 20 | 45 sec. | 1.4 | 0.04 | " |
| | | 20 sec. | 2.0 | 0.05 | |

AS shown in Table 11, the metal chelate compounds for use in this invention are excellent in the desilvering property and the formation of stains upon storage after processing as compared with the comparison compounds. In particular, the effects are remarkable in the processing of shortening the blixing time. That is, when the blixing time is shortened to half, the residual silver amount is less and the formation of stain with the passage of time after processing is less even before and after running. On the other hand, in the case of the comparison compounds, when the sample was processed with the processing solution immediately after preparation, the residual silver was scarcely observed, but with the progress of running, the desilvering property was greatly reduced as shown above, and further precipitates formed.

EXAMPLE 13

When the same procedure as processings 801 to 809 in Example 8 was followed using Fuji Color Super HG 400 (Production No. 311130, trade name, made by Fuji Photo Film Co., Ltd.) and Fuji Color REALA (Production No. 861016, trade name, made by Fuji Photo Film Co., Ltd.), almost same results as Example 8 were confirmed.

EXAMPLE 14

The multilayer color photographic material as in Example 1 was sliced into a width of 35 mm, subjected to a light exposure of 5 CMS at a color temperature of 4800° K., and then processed by the following processing steps using the following processing solutions and a cine automatic processor. In addition, as the bleaching solution, samples 1401 to 1408 including comparison samples and the samples of this invention were prepared and each sample was used for each case.

| (Processing Steps) | | |
|---|---|---|
| Step | Processing Time | Processing Temperature (°C.) |
| Color Development | 3 min. and 15 sec. | 37.8 |
| Bleach | 3 min. | 38.0 |
| Wash | 30 sec. | 38.0 |
| Fix | 3 min. | 38.0 |
| Wash (1) | 30 sec. | 30.0 |
| Wash (2) | 30 sec. | 30.0 |
| Stabilization | 65 sec. | 38.0 |
| Drying | 2 min. | 55.0 |

As described above, in this example, the time from the bleach step before drying was 8 minutes and 35 seconds.

The formulas of the processing solutions used in the above processing steps are shown below.

| | |
|---|---|
| (Color Developer) | |
| Water | 800 ml |
| Potassium Carbonate | 32.0 g |
| Sodium Bicarbonate | 1.8 g |
| Sodium Sulfite | 3.8 g |
| Potassium Hydroxide | 1.7 g |
| Diethylenetriaminepentaacetic Acid | 1.2 g |
| 1-Hydroxyethylidene-1,1-diphosphonic Acid | 2.0 g |
| Potassium Bromide | 1.4 g |
| Hydroxylamine Sulfate | 2.5 g |
| Potassium Iodide | 0.0013 g |
| 2-Methyl-4-(N-ethyl-N-β-hydroxyethyl-amino)aniline Sulfate | 4.7 g |
| Water to make | 1 liter |
| pH | 10.05 |
| (Bleach Solutions 1401 to 1408) | |
| Water | 700 ml |
| Chelate Compound (shown in Table 12 below) | 0.11 mol |
| Ferric Chloride | 0.10 mol |
| Sodium Bromide | 0.86 mol |
| Sodium Nitrate | 0.38 mol |
| Acetic Acid | 0.30 mol |
| Sodium Hydroxide | 0.10 mol |
| pH adjusted by adding sodium hydroxide and sulfuric acid | 4.8 |
| Water to make | 1 liter |
| (Fixing Solution) | |
| Water | 700 ml |
| Disodium Ethylenediaminetetraacetate | 1.7 g |
| Sodium Sulfite | 14.0 g |
| Ammonium Thiosulfate | 170.0 g |
| Silver Bromide | 15.0 g |
| Ammonium Iodide | 0.9 g |
| Water to make | 1 liter |
| (Stabilization Solution) | |
| Water | 900 ml |
| Pyrazole | 4.0 g |
| Formalin (37% formaldehyde soln.) | 1.5 ml |
| Polyoxyethylene-p-monononyl Phenyl Ether (average polymerization degree 10) | 0.3 g |
| Disodium Ethylenediaminetetraacetate | 0.05 g |
| Water to make | 1 liter |

-continued

| | |
|---|---|
| pH | 5.8 |

For the color photographic materials processed by the foregoing method, the residual silver amount was measured by the following method.

That is, the amount of silver remaining in each color photographic material thus processed was measured by a fluorescent X-ray analysis method.

The results obtained are shown in Table 12.

TABLE 12

| No. | Chelate compound | Residual Silver Amount ($\mu g/cm^2$) | |
|---|---|---|---|
| 1401 | Comparison Compound A | 35.6 | Comparison |
| 1402 | Comparison B | 5.1 | " |
| 1403 | Compound 1 | 2.4 | Invention |
| 1404 | Compound 3 | 2.0 | " |
| 1405 | Compound 4 | 1.1 | " |
| 1406 | Compound 17 | 3.0 | " |
| 1407 | Compound 20 | 2.5 | " |
| 1408 | Compound 22 | 3.5 | " |

As shown in Table 12, in the case of using each of Bleach Solution 1403 to 1408 in this invention, the amount of silver in the color photographic material after processing is greatly less.

As described above in detail, the processing solutions each containing the compound shown by formula (I) have the following advantages.

(1) The oxidation or decomposition of components in the processing solution by the action of metal ions is restrained, whereby the performance of the processing solution can be kept for a long period of time.

(2) Precipitates do not form in the processing solution by the accumulation of metal ions, and hence troubles such as staining of the photographic films processed and clogging of the filter of the automatic processor do not occur.

(3) The image storage stability of the photographic light-sensitive materials after processing is improved.

Also, the processing solutions each containing the metal chelate compound shown by formula (I) have the following advantages.

(1) Desilvering processing can be quickly carried out without the formation of bleach fog and with less formation of stains after processing.

(2) Deviation of the processing performance before and after running processing is less.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material, which comprises processing an imagewise exposed silver halide color photographic material with a processing solution containing at least one of Fe(III), Mn(III), Co(III), Rh(II), Rh(III), Au(II), Au(III) and Ce(IV) chelate compounds of a compound represented by formula (I);

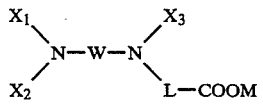

(I)

wherein $X_1$, $X_2$, and $X_3$ each represents a hydrogen atom, —L—COOM, or

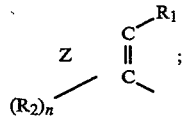

at leat one of $X_1$, $X_2$, and $X_3$ represents

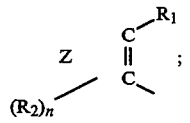

Z represents a carbon atomic group necessary for forming a phenyl group or a naphthyl group; $R_1$ represents a hydr.oxy group, $—SO_3M^3$, $—COOM^3$ or a nitro qroup; $R_2$ represents an alkyl group, an alkoxy group, an acylamino group, a ureido group, an aryloxycarbonylamino group, a carbamoyl group, an alkylthio group, an alkylsulfonyl group, an arylsulfonyl group, an alkylsulfinyl group, an arylsulfinyl group, a hydroxy group, a halogen atom, a cyano group, $—SO_3M^1$, $—COOM^1$, $—PO_3M^1M^2$ group, an acyl group, an alkoxycarbonyl group, an acyloxy group, a nitro group, or a hydroxamic acid group; n represents 0 or an integer of 1 or 2; L represents an alkylene group; M, $M^1$ $M^2$ and $M^3$ each represents a hydrogen atom or a cation; and W represents a divalent linkage group represented by the following formula (W);

$$—(W^1—D)_m—W^2— \quad (W)$$

wherein $W^1$ and $W^2$ which may be the same or different each represents a straight chain or branched alkylene group [having from 2 to 4 carbon atoms,]and D represents —O—, —S—, or $—N(R_w)—$, m represents an integer of from 0 to 3, and when m is 2 or 3, (W-D) may be the same or different, $R_w$ represents a hydrogen atom, an alkyl group or an aryl group, each group may be substituted with $—COOM^2$, $—PO_3M^3M^4$, —OH, or $—SO_3M_5$ (wherein $M_2$, $M_3$, $M_4$, and $M_5$ each has the same meaning as M above.

2. The method for processing a silver halide color photographic material as claimed in claim 1, wherein $R_1$ represents a $—COOM_3$, wherein $M_3$ represents a hydrogen atom or a cation.

3. The method for processing a silver halide color photographic material as claimed in claim 1, wherein $R_2$ represents a hydroxy group, $—SO_3M^1$, $—COOM^2$ or a nitro group.

4. The method for processing a silver halide color photographic material as claimed in claim 1, wherein m is 0.

5. The method for processing a silver halide color photographic material as claimed in claim 1, wherein L represents a methylene group or an ethylene group.

6. The method for processing a silver halide color photographic material as claimed in claim 1, wherein Z represents a carbon atomic group necessary for forming a phenyl group.

7. The method for processing a silver halide color photographic material as claimed in claim 4, wherein said compound represented by formula (I) is a compound represented by formula (II) or (III);

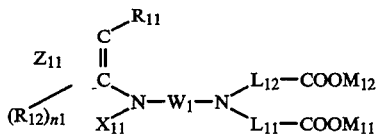

(II)

wherein $X_{11}$ represents a hydrogen atom, $—L_{1-3}—COOM_{13}$, or

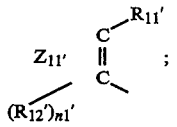

$Z_{11}$ and $Z_{11}'$ each has the same meaning as Z in formula (I); $R_{11}$ and $R_{11}'$ each has the same meaning as $R_1$ in formula (I); $R_{12}$ and $R_{12}'$ each has the same meaning as $R_2$ in formula (I); $n_1$ and $n_1'$ each has the same meaning as n in formula (I); $W_1$ has the same meaning as W in formula (I); $L_{11}$, $L_{12}$, and $L_{13}$ each has the same meaning as L in formula (I); and $M_{11}$, $M_{12}$, and $M_{13}$ each has the same meaning as M in formula (I):

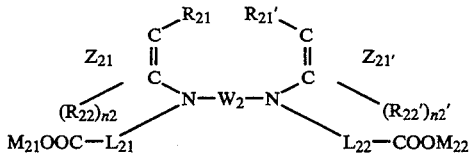

(III)

wherein $Z_{21}$ and $Z_{21}'$ each has the same meaning as Z in formula (I); $R_{21}$ and $R_{21}'$ each has the same meaning as $R_1$ in formula (I); R22 and R'22 has the same meaning as $R_2$ in formula (I); $n_2$ and $n_2'$ each has the same meaning as n in formula (I); $W_2$ has the same meaning as W in formula (I); $L_{21}$ and L22 each has the same meaning as L in formula (I); and $M_{21}$ and M22 each has the same meaning as M in formula (I).

8. The processing method for a silver halide color photographic material as claimed in claim 1, wherein said chelating compound is incorporated in an amount of 1 m mol to 1 mol per liter of the processing solution.

9. The processing method for a silver halide color photographic material as claimed in claim 1, wherein said processing solution is a bleaching solution or blix solution and the chelate compound is incorporated therein as a bleaching agent.

10. The method for processing a silver halide color photographic material as claimed in claim 7, wherein $R_{11}$ is $—COOM_{33}$ and $X_{11}$ is $—L_{13}COOM$_, wherein M33 has the same meaning as M in formula (I).

11. A method for processing a silver halide color photographic material as claimed in claim 1, wherein $W^1$ and $W^2$ each represents an alkylene group having from 2 to 4 carbon atoms.

* * * * *